US008027502B2

(12) United States Patent
Mitobe et al.

(10) Patent No.: US 8,027,502 B2
(45) Date of Patent: Sep. 27, 2011

(54) SPEAKER DEVICE AND MOBILE PHONE

(75) Inventors: Kunio Mitobe, Yamagata (JP); Shinsuke Konuma, Yamagata (JP)

(73) Assignees: Pioneer Corporation, Tokyo (JP); Tohoku Pioneer Corporation, Tendo-shi (JP)

( * ) Notice: Subject to any disclaimer, the term of this patent is extended or adjusted under 35 U.S.C. 154(b) by 1314 days.

(21) Appl. No.: 11/642,964

(22) Filed: Dec. 21, 2006

(65) Prior Publication Data

US 2007/0140521 A1 Jun. 21, 2007

(30) Foreign Application Priority Data

Dec. 21, 2005 (JP) ..... 2005-368527

(51) Int. Cl.
*H04R 1/02* (2006.01)
*H04R 1/00* (2006.01)

(52) U.S. Cl. ..... 381/386; 381/409; 381/410; 381/412; 381/420; 381/423

(58) Field of Classification Search ..... 381/177, 381/400, 405, 407, 412, 421
See application file for complete search history.

(56) References Cited

U.S. PATENT DOCUMENTS

| | | | | |
|---|---|---|---|---|
| 5,157,731 | A | 10/1992 | Mitobe | |
| 5,892,185 | A | 4/1999 | Takahashi et al. | |
| 6,154,556 | A | 11/2000 | Takahashi et al. | |
| 6,973,194 | B2 * | 12/2005 | Iwasa et al. | 381/412 |
| 2003/0164262 | A1 * | 9/2003 | Ito et al. | 181/171 |
| 2004/0086150 | A1 * | 5/2004 | Stiles | 381/421 |
| 2005/0041830 | A1 * | 2/2005 | Takewa et al. | 381/410 |
| 2007/0140520 | A1 | 6/2007 | Konuma et al. | |
| 2007/0147651 | A1 | 6/2007 | Mitobe et al. | |

FOREIGN PATENT DOCUMENTS

| | | |
|---|---|---|
| JP | 5-030592 | 2/1993 |
| JP | H10-191494 | 7/1998 |
| JP | H11-187484 | 7/1999 |
| JP | H11-187485 | 7/1999 |
| JP | 2000-350284 | 12/2000 |
| JP | 3334842 | 10/2002 |
| JP | 3337631 | 10/2002 |

OTHER PUBLICATIONS

"New Edition Encyclopedia of Speakers and Enclosures", Tamon Saeki, Seibundo-Shinkosha, Aug. 1, 2002, vol. 3., p. 40 and its English partial translation.
Mitobe et al., U.S. Appl. No. 11/642,962, filed Dec. 21, 2006.
Konuma et al., U.S. Appl. No. 11/641,116, filed Dec. 19, 2006.

* cited by examiner

*Primary Examiner* — Curtis Kuntz
*Assistant Examiner* — Sunita Joshi
(74) *Attorney, Agent, or Firm* — Nixon & Vanderhye P.C.

(57) ABSTRACT

A speaker device includes a magnetic circuit which includes a magnetic gap, a diaphragm which has a recessed part arranged in the magnetic gap and extending in a direction substantially orthogonal with respect to an extending direction of a magnetic flux in the magnetic gap, and a voice coil which is formed into an annular shape and has a first parallel part extending in one direction and a second parallel part extending in a direction in parallel with the first parallel part and opposite to the first parallel part with a constant space. Particularly, the first parallel part and the second parallel part are arranged in a direction in parallel with an extending direction of the recessed part, respectively. The first parallel part is arranged in the recessed part to be positioned in the magnetic gap, and the second parallel part is positioned above the recessed part.

18 Claims, 13 Drawing Sheets

SPEAKER DEVICE AND MOBILE PHONE

BACKGROUND OF THE INVENTION

1. Field of the Invention

The present invention relates to a configuration of a speaker device preferably usable for a mobile phone.

2. Description of Related Art

Conventionally, there is known a Ryffel-type speaker including a rectangular diaphragm and a liner voice coil arranged at a central part of the diaphragm (see "New Edition Encyclopedia of Speakers and enclosures" Tamon Saeki, Seibundo-Shinkosha, Aug. 1, 2002, Vol. 3, P. 40, for example). The speaker having a configuration of this kind is disclosed in Japanese Patent Applications Laid-open under No. 11-187484, No. 11-187485, No. 2000-350284 and No. 10-191494, which are referred to as References-1 to 4, respectively.

The speaker according to Reference-1 mainly includes two diaphragms and a magnetic circuit including two, i.e., upper and lower magnetic gaps in parallel with each other and having opposite magnetic flux directions. At substantial centers on rear surfaces of the respective diaphragms, two, i.e., upper and lower voice coils are arranged, respectively. Thereby, it is said that, even with an elongated configuration having narrow opening diameter and horizontal width, a minimum resonance frequency f0 can be low, and withstand input and a characteristic between low frequency reproduction and a sound pressure frequency can be improved.

The speaker according to Reference-2, also having the substantially same configuration as that of Reference-1, further has such a configuration that an acoustic wave of same phase is outputted from the two diaphragms. Thereby, it is said that sound interference from a rear surface can be prevented.

The speaker according to Reference-3 includes two rectangular diaphragms mainly stuck with each other on one sides to be in a dome state, and two plane voice coils provided on the other sides of the diaphragms to be arranged in magnetic gaps. Thereby, the gap width of the magnetic gap can be very small, and even if a magnet with a low price and comparatively small magnetism is used, the magnetism in the magnetic gap can be very large. Therefore, it is said that the speaker for a high frequency with high sound quality can be obtained with a low price.

The speaker according to Reference-4 mainly includes a rectangular diaphragm, a plate-shaped driving force transmission member connected with the diaphragm and inserted to the magnetic gap of the magnetic circuit, a damper formed into a substantially "S" shape, and a voice coil connected with a driving force transmission member. Thereby, suppression of displacement difference in an up-and-down direction, reduction of non-linear distortion at large magnitude and low frequency reproduction can be realized. The speaker includes one or two magnetic gap(s) in which the voice coil is arranged.

Supporting methods of the voice coil at a predetermined position of the diaphragm in the speaker are disclosed in Japanese Patent Publications No. 3337631 and No. 3334842.

The speaker according to Reference-5 includes a recessed part having a U-shaped cross-section at an outer peripheral edge portion of the diaphragm in a ring state, an edge damper at an outer peripheral edge portion of the recessed part, and a cylindrical voice coil attached to the inside of the recessed part by an adhesive. The voice coil is arranged in the magnetic gap of the magnetic circuit together with the recessed part and supported in a floating manner by the edge damper. Additionally, in the speaker according to Reference-6, the diaphragm has the voice coil arranged on an outer circumferential surface of a short cylindrical part provided at an end edge part of a main part formed into a semi-sphere shape.

However, the speaker device according to the above-mentioned References-1 and 2 structurally becomes thick in the vibration direction of the diaphragm, and there is such a problem that the speaker device is hardly applied to a recent mobile phone of a thin-type.

SUMMARY OF THE INVENTION

The present invention has been achieved in order to solve the above problem. It is an object of this invention to provide a speaker device capable of obtaining a low frequency and being thin and slim.

According to one aspect of the present invention, there is provided a speaker device including: a magnetic circuit which includes a magnetic gap; a diaphragm which has a recessed part arranged in the magnetic gap and extending in a direction substantially orthogonal with respect to an extending direction of a magnetic flux in the magnetic gap; and a voice coil of an annular shape, which includes a parallel part extending in one direction and at least one other parallel part extending in a direction in parallel with the parallel part, wherein the parallel part and the other parallel part are arranged in a direction in parallel with an extending direction of the recessed part, respectively, and wherein an entire or one part of the parallel part is arranged in the recessed part to be positioned in the magnetic gap, and the other parallel part is positioned on an upper side of the diaphragm, which is a sound output side of the diaphragm.

The above speaker device includes the magnetic circuit having the magnetic gap, the diaphragm arranged in the magnetic gap and having the recessed part extending in the direction substantially orthogonal with respect to the extending direction of the magnetic flux (magnetism) in the magnetic gap, and the voice coil of an annular shape, having the parallel part extending in the direction and the other parallel part extending in the direction in parallel with the parallel part. In a preferred example, the direction of the sound current flowing in the parallel part and the direction of the sound current flowing in the other parallel part may be relatively opposite. In another preferred example, the positional relation between the parallel part and the other parallel part may be preferably prescribed so that the other parallel part is positioned in the magnetic gap, when the excessive sound current is inputted to the voice coil and the voice coil largely vibrates in the direction opposite to the sound output direction of the diaphragm.

Particularly, in the speaker device, the parallel part and the other parallel part are arranged in the direction in parallel with the extending direction of the recessed part, respectively. The entire or the part of the parallel part is arranged in the recessed part and positioned in the magnetic gap, and the other parallel part is positioned on the upper side of the diaphragm, which is the sound output side. Thereby, the parallel part of the voice coil is arranged in the vicinity of the magnetic circuit positioned on the side opposite to the sound output direction, and the speaker device can be thin. The recessed part of the diaphragm is formed to extend in the direction substantially orthogonal with respect to the extending direction of the magnetic flux, and the parallel part and the other parallel part are arranged in the direction in parallel with the extending direction of the recessed part, respectively. In the recessed part, the entire or the part of the parallel part is arranged, and thereby the speaker device can be slim. Thus, the speaker can be preferably used as the speaker device for a receiver part and/or for a call-indicating part in the mobile phone which recently becomes thinner and slimmer. Additionally, the speaker device able to be thin or slim can be preferably used for various kinds of electronic equipments for a mobile or for a neighboring acoustic field, other than the speaker device for the mobile phone.

In the speaker device, when the sound current flows in the constant direction at the parallel part of the voice coil, the parallel part vibrates in the direction of the central axis of the speaker device in accordance with Fleming's left-hand rule. Thereby, the acoustic wave is outputted in a predetermined direction via the diaphragm. However, at the time of driving of the speaker device, when the excessive sound current is inputted to the voice coil due to any cause and the voice coil largely moves to the side of the magnetic circuit opposite to the sound output direction of the speaker device and the parallel part and the other parallel part are positioned in the magnetic gap, the driving forces of the same amount in the relatively opposite direction operate on the parallel part and the other parallel part.

Particularly, in the speaker device, since the other parallel part is positioned on the upper side of the diaphragm, which is the sound output side of the diaphragm, even in the above case, the parallel part and the at least one other parallel part interact with the magnetic flux in the magnetic gap. Namely, the driving force operating on the parallel part in the magnetic gap balances with the driving force of the same amount and opposite direction operating on the at least one other parallel part, and the at least one other parallel part prevents the voice coil from moving further to the direction of the magnetic circuit side, functioning as a stopper. Namely, the movement of the voice coil to the side of the magnetic circuit from this position is limited. Thereby, it can be prevented that the part in the vicinity of the recessed part of the diaphragm and the magnetic circuit contact or collide. This point can make the speaker device thin. Since the diaphragm has the elastic force for returning to the initial position, the voice coil does not stay at the balanced position. When the sound current is appropriately inputted to the voice coil, the voice coil instantly returns to the above appropriate vibration state by the elastic force.

According to another aspect of the present invention, there is provided a speaker device including: a magnetic circuit which includes a magnetic gap; a diaphragm which has a recessed part arranged in the magnetic gap and extending in a direction substantially orthogonal with respect to an extending direction of a magnetic flux in the magnetic gap; and a voice coil which is formed into an annular shape and has a first parallel part extending in one direction and a second parallel part extending in a direction in parallel with the first parallel part and opposite to the first parallel part with a constant space, wherein the first parallel part and the second parallel part are arranged in a direction in parallel with an extending direction of the recessed part, respectively, and wherein an entire or one part of the first parallel part is arranged in the recessed part to be positioned in the magnetic gap, and the second parallel part is positioned above the recessed part and on a sound output side of the diaphragm.

The above speaker device includes the magnetic circuit having the magnetic gap, the diaphragm arranged in the magnetic gap and having the recessed part extending in the direction substantially orthogonal with respect to the extending direction of the magnetic flux (magnetism) in the magnetic gap, and the voice coil formed into the annular shape and having the first parallel part extending in the one direction and the second parallel part extending in the direction in parallel with the first parallel part and opposite to the first parallel part with the constant space. In a preferred example, the direction of the sound current flowing in the first parallel part and the direction of the sound current flowing in the second parallel part may be relatively opposite. In another preferred example, the positional relation between the first parallel part and the second parallel part may be preferably prescribed so that the second parallel part is positioned in the magnetic gap, when the excessive sound current is inputted to the voice coil and the voice coil largely moves to the direction opposite to the sound output direction of the diaphragm.

Particularly, in the speaker device, the first parallel part and the second parallel part are arranged in the direction in parallel with the extending direction of the recessed part, respectively, and the entire or the part of the first parallel part is arranged in the recessed part of the diaphragm to be positioned in the magnetic gap. The second parallel part is positioned above the recessed part and the sound output side of the diaphragm. Thereby, the first parallel part of the voice coil is arranged in the vicinity of the side of the magnetic circuit positioned on the side opposite to the sound output direction, and thereby the speaker device can be thin. In addition, the recessed part of the diaphragm is formed to extend in the direction substantially orthogonal with respect to the extending direction of the magnetic flux, and the first parallel part and the second parallel part are arranged in the direction in parallel with the extending direction of the recessed part, respectively. The entire or the part of the first parallel part is arranged in the recessed part. Therefore, the speaker device can be slim. Thus, the speaker device can be preferably used as the speaker device for the receiver part and/or for the call-indicating part in the mobile phone which recently becomes thinner and slimmer. Further, the thin and slim speaker device can be preferably used for various kinds of electronics for the mobile or for the neighboring acoustic field, other than the speaker device for the mobile phone.

Additionally, in the speaker device, when the sound current flows in the constant direction in the first parallel part of the voice coil, the first parallel part vibrates in the direction of the central axis of the speaker device, in accordance with Fleming's left-hand rule. Thereby, the acoustic wave is outputted in the predetermined direction via the diaphragm. However, at the time of the driving of the speaker device, when the excessive sound current is inputted to the voice coil due to any cause and the voice coil largely moves to the side of the magnetic circuit on the side opposite to the sound output direction of the speaker device and the first parallel part and the second parallel part are positioned in the magnetic gap, the forces of the same amount in the relatively opposite direction operate on the first parallel part and the second parallel part.

Particularly, in the speaker device, since the second parallel part of the voice coil is arranged above the recessed part and on the sound output side of the diaphragm, the first parallel part and the second parallel part interact with the magnetic flux in the magnetic gap. Namely, the driving force operating on the first parallel part in the magnetic gap balances with the driving force of the same amount and opposite direction operating on the second parallel part, and the second parallel part prevents the voice coil from moving further to the direction of the magnetic circuit side, functioning as a stopper. Namely, the movement of the voice coil to the magnetic circuit from the position is limited. Thereby, it can be prevented that the part in the vicinity of the recessed part of the diaphragm and the magnetic circuit contact or collide. This point can make the speaker device thin. Since the diaphragm has the elastic force for returning to the initial position, the voice coil does not stay at the balanced position. When the appropriate sound current is inputted to the voice coil, the voice coil instantly returns to the above-mentioned appropriate vibration state by the elastic force.

According to still another aspect of the present invention, there is provided a speaker device including: a magnetic circuit which includes a magnetic gap; a diaphragm which has a recessed part arranged in the magnetic gap and extending in a direction substantially orthogonal with respect to an extending direction of a magnetic flux in the magnetic gap; and a voice coil which has a Y-shaped cross-section and has a first part having a first parallel part extending in one direction, a second part having a second parallel part extending in a direction in parallel with the first parallel part and connected with the first part to form an annular shape, and a third part having a third parallel part extending in the direction in parallel with the first parallel part and connected with the first part to form an annular shape, the third parallel part being arranged at a position symmetrical with the second parallel part with respect to a central line passing through a center in a width direction of the first parallel part, the width direction corresponding to an extending direction of the magnetic flux, wherein the first parallel part, the second parallel part and the third parallel part are arranged in a direction in parallel with an extending direction of the recessed part, respectively, and wherein an entire or one part of the first parallel part is arranged in the recessed part to be positioned in the magnetic gap, and the second parallel part and the third parallel part are positioned on an upper surface on a sound output side of the diaphragm, respectively.

In a preferred example, the direction of the sound current flowing in the first parallel part and the direction of the sound current flowing in the second parallel part and the third parallel part may be relatively opposite. In another preferred example, the positional relation between the first parallel part and each of the second parallel part and the third parallel part may be prescribed so that the second and third parallel parts are positioned in the magnetic gap, when the excessive sound current is inputted to the voice coil and the voice coil largely moves to the direction opposite to the sound output direction of the diaphragm.

Particularly, in the speaker device, the first to third parallel parts are arranged in the direction in parallel with the extending direction of the recessed part, respectively, and the entire or the part of the first parallel part is arranged in the recessed part and positioned in the magnetic gap. The second parallel part and the third parallel part are positioned on the upper surface on the sound output side of the diaphragm, respectively. Thereby, the first parallel part of the voice coil is arranged at the position in the vicinity of the rear surface of the magnetic circuit positioned on the side opposite to the sound output direction, and thereby the speaker device can be thin. The recessed part of the diaphragm is formed to extend in the direction substantially orthogonal with respect to the extending direction of the magnetic flux, and the entire or the part of the first parallel part is arranged in the recessed part. Therefore, the speaker device can be slim. Hence, the speaker device can be preferably used for the speaker device for the receiving part and/or for the call-indicating part in the mobile phone which recently becomes thinner and slimmer. In addition, the speaker device becoming thin and slim can be preferably used for various kinds of electronic equipments for the mobile and for the neighboring acoustic field, other than the speaker device for the mobile phone.

In addition, in the speaker device, when the sound current flows to the constant direction in the first parallel part of the voice coil, the first parallel part vibrates in the direction of the central axis of the speaker device, in accordance with Fleming's left-hand rule. Thereby, the acoustic wave is outputted in the predetermined direction via the diaphragm. However, at the time of the driving of the speaker device, when the excessive sound current is inputted to the voice coil due to any cause and the voice coil largely moves to the magnetic circuit side opposite to the sound output direction of the speaker device and the first to third parallel parts are positioned in the magnetic gap, the driving forces of the same amount in the relatively opposite direction operate on the first to third parallel parts.

Particularly, in the speaker device, since the second and third parallel parts of the voice coil are fixed onto the upper surface of the sound output side of the diaphragm, respectively. Even in the above case, the first parallel part, the second parallel part and the third parallel part interact with the magnetic flux in the magnetic gap. Namely, the driving force operating on the first parallel part in the magnetic gap balances with the driving force of the same amount and opposite direction operating on the second parallel part and the third parallel part, and the second parallel part and the third parallel part prevent the voice coil from moving further to the direction of the magnetic circuit side, functioning as a stopper. Namely, the movement of the voice coil to the side of the magnetic circuit from the position is limited. Thereby, it can be prevented that the part in the vicinity of the recessed part of the diaphragm and the magnetic circuit contact or collide. This point can make the speaker device thin. Since the diaphragm has the elastic force for returning to the initial position, the voice coil does not stay at the balanced position. When the appropriate sound current is inputted to the voice coil, the voice coil instantly returns to the above appropriate vibration state by the elastic force. Additionally, the second parallel part and the third parallel part are positioned on the upper surface side, i.e., on the sound output side of the diaphragm, respectively. Therefore, at the time of the sound reproduction, the vibration system including the voice coil and the diaphragm can be smoothly and stably moved.

In a manner of the above speaker device, the magnetic gap may be formed at a substantially central position of the magnetic circuit, and the diaphragm may have a plane shape formed into an elongated circular or ellipse shape, and the recessed part of the diaphragm is formed into an elongated shape and a U-shaped cross-section to be arranged at a substantially central part of the diaphragm and in the magnetic gap.

In this manner, the magnetic gap is formed at the substantially central position of the magnetic circuit. The diaphragm has the plane shape formed into the elongated circular or ellipse shape. The recessed part of the diaphragm is formed into an elongated shape and a U-shaped cross-section to be arranged at the substantially central position of the diaphragm and in the magnetic gap. Thereby, the speaker device can be slim. In addition, the voice coil can be arranged at the substantially central position of the diaphragm and in the magnetic gap. As a result, the diaphragm can be smoothly and stably moved at the time of the sound reproduction, and the strength of the entire vibration system including the diaphragm and the voice coil is sufficiently ensured.

In another manner of the above speaker device, the entire or the part of the first parallel part may be sandwiched and fixed by side surfaces of the recessed part. Thereby, the voice coil is stably maintained by the recessed part, and such a disadvantage that the voice coil is easily bent in the vibration direction is overcome. Namely, thereby, the voice coil is hardly bent in the vibration direction. Thus, it becomes possible to appropriately position the first parallel part in the magnetic gap.

In another manner of the above speaker device, the magnetic circuit may include a yoke, a pair of magnets formed into a rectangular parallelepiped shape, oppositely mounted on an upper surface of the yoke with a constant space, a positional relation of an S-pole and an N-pole of one of the pair of the magnets being reverse to the positional relation of the S-pole and the N-pole of the other one of the pair of the magnets with respect to a vibration direction of the diaphragm, and a pair of plates formed into a rectangular parallelepiped or flat-plane shape and mounted on each of upper surfaces of the pair of magnets, and the magnetic gap may be formed between the pair of plates.

Thereby, since the first parallel part arranged in the recessed part of the diaphragm is arranged at the position in the vicinity of the yoke and at the substantially central position of the magnetic circuit, the speaker device can be thin and slim. Additionally, at the time of the driving of the speaker device in this manner, even when the excessive sound current is inputted to the voice coil due to any cause and the voice coil and the diaphragm largely moves to the direction opposite to the sound output direction of the speaker device, since the second parallel part functions as the above stopper, it can be prevented that the part in the vicinity of the recessed part of the diaphragm and the plate contact or collide.

In another manner of the above speaker device, an additional magnet may be mounted on an upper surface of at least one of the pair of plates, and a positional relation of an S-pole and an N-pole of one of the other magnet may be reverse to the positional relation of the S-pole and the N-pole of the magnet, sandwiching the plate and opposite to each other, with respect to a vibration direction of the diaphragm.

Since the additional magnet is arranged at the position reacting against the magnet, it is generally referred to as "reaction magnet".

In this manner, since the additional magnet serving as the reaction magnet is provided in addition to the pair of magnets, the magnitude of the magnetism in the magnetic field in the magnetic gap can be large by the amount. Thereby, the sensitivity (efficiency) can be increased. Additionally, when the excessive sound current is inputted to the voice coil due to any cause and the voice coil largely moves to the side opposite to the sound output direction, the function as the stopper to temporarily and instantly stop the movement of the voice coil in the direction can be further enhanced.

In still another manner of the above speaker device, the magnetic circuit may include a yoke, a magnet formed into a rectangular parallelepiped shape and mounted on an upper surface of the yoke, a magnetic body oppositely mounted on the upper surface of the yoke with a constant space to the magnet, and a plate formed into a rectangular parallelepiped or flat-plane shape and mounted on an upper surface of the magnet, and the magnetic gap may be formed between the magnet and the magnetic body.

In this manner, the magnetic circuit includes a yoke, a magnet formed into a rectangular parallelepiped shape and mounted on an upper surface of the yoke, a magnetic body, made of a metallic member such as iron, oppositely mounted on the upper surface of the yoke with a constant space to the magnet, and a plate formed into a rectangular parallelepiped or flat-plane shape and mounted on an upper surface of the magnet. The magnetic gap is formed between the magnet and the magnetic body.

Therefore, there are operation and effect described below. Namely, when the numbers of magnets and plates become small, the sensitivity is reduced by the amount. However, according to the specification of the electronic equipments such as the mobile phone to which the speaker device is applied, the high sensitivity and efficiency are not always necessary. For example, as the speaker device used for the mobile phone, there are two kinds, i.e., for the receiver part and for the call-indicating part. In the case of the speaker device for the receiver part, though the priorities of the miniaturization and lowering the minimum resonance frequency f0 (low f0) are high as a specification, the high sensitivity and efficiency are not so necessary. Thus, in the case, in consideration of the manufacturing cost, it is preferable that the speaker device in this manner is applied as the receiver of the mobile phone. Namely, as the preferred speaker device for the mobile phone for which the high sensitivity and efficiency are not so necessary, it is preferable to apply the speaker device in this manner whose sensitivity and efficiency are slightly inferior to those of the above-mentioned speaker device by the amount of insufficiently setting number of magnets, but whose manufacturing cost is lower than that of the above-mentioned speaker device by the amount of inferiority.

In still another manner of the above speaker device, the magnetic circuit may include a yoke, and a pair of magnets formed into a rectangular parallelepiped shape, oppositely mounted on an upper surface of the yoke with a constant space, a positional relation of an S-pole and an N-pole of one of the pair of the magnets being reverse to the positional relation of the S-pole and the N-pole of the other one of the pair of the magnets with respect to an extending direction of the magnetic flux, and the magnetic gap may be formed between the pair of magnets.

Namely, in this manner, since the magnetic circuit includes no pair of plates, the sensitivity and efficiency are slightly reduced as compared with the above-mentioned speaker device by the amount. Inversely, the manufacturing cost can be reduced. Thus, in consideration of the sensitivity and efficiency of the electronics such as the mobile phone and the manufacturing cost, the speaker device according to this manner is preferably usable as the speaker device for the receiver of the mobile phone, for example. In addition, since the pair of plates are not provided, the height of the speaker device, corresponding to the vibration direction of the diaphragm and the voice coil, can be small by the amount, and the thinner speaker device can be realized.

In another embodiment of the above speaker device, in consideration of the sensitivity, the efficiency and the manufacturing cost, the magnetic circuit may include the yoke, the magnet formed into the rectangle shape and arranged on the upper surface of the yoke, the magnetic body oppositely arranged on the upper surface of the yoke with the constant space to the magnet, and further the magnetic gap between the magnet and the magnetic body. Thereby, since the magnetic circuit does not include the pair of plates, the height of the speaker device, corresponding to the vibration direction of the diaphragm and the voice coil, can be small by the amount, and the thinner speaker device can be realized.

In still another manner of the above speaker device, the entire or the part of the second parallel part may be arranged in the recessed part and sandwiched and fixed by side surfaces of the recessed part.

In this manner, since not only the first parallel part but also the entire or the part of the second parallel part are fixed to the recessed part of the diaphragm, the strength and the stability at the time of the vibration of the vibration system including the voice coil and the diaphragm can be realized. By employing this manner, the height of the speaker device, corresponding to the vibration direction of the diaphragm and the voice coil, can be small, and the thinner speaker device can be realized.

In still another manner, the speaker device may further include a frame having a plane shape formed into a cylindrical, annular, elongated circular or ellipse shape and housing the magnetic circuit. A step part formed into a step state may be formed at an outer peripheral portion on an upper surface of the frame. The diaphragm may have a sound output part provided around the recessed part, having a semi-sphere cross-section and having a function to output an acoustic wave, and a step part provided at an outer peripheral portion of the sound output part and having a step part engaged with the step part of the frame. The step part of the diaphragm may become engaged with the step part of the frame, and the recessed part may be arranged at a substantially central position of the frame.

In this manner, the speaker device further includes a frame having a plane shape formed into a cylindrical, annular, elongated circular or ellipse shape and housing the magnetic circuit. A step part formed into a step state is formed at an outer peripheral portion on an upper surface of the frame. The diaphragm has a sound output part provided around the recessed part, having a semi-sphere cross-section and having a function to output an acoustic wave, and a step part provided at an outer peripheral portion of the sound output part and having a step part engaged with the step part of the frame. In addition, the step part of the diaphragm becomes engaged with the step part of the frame, and the recessed part of the diaphragm is arranged at a substantially central position of the frame. Thereby, the voice coil can be arranged at the substantially central position of the speaker device, i.e., at the substantially central position of the frame, and the relatively positional relation between the voice coil and the diaphragm can be appropriately set. In addition, the diaphragm can be smoothly and stably moved at the time of the sound reproduction, and the intensity as the entire vibration system including the voice coil and the diaphragm can be sufficiently ensured.

In still another manner of the above speaker device, the sound output part may have a function of an edge, and a length in a lateral direction of the sound output part may occupy a major part of a length in a lateral direction of the diaphragm.

Generally, when the edge width becomes large, the edge correspondently becomes soft. The resonance frequency of the speaker device can be lowered, and the voice coil can be close to the central position of the speaker device. Thereby, the minimum resonance frequency f0 can be lowered, and the low frequency can be easily obtained. In this point, in this manner, the sound output part has the function of the edge for absorbing the unnecessary vibration at the time of the sound reproduction, and the length in the lateral direction of the sound output part occupies the major part of the length in the lateral direction of the diaphragm, the edge width inevitably becomes large. Therefore, the minimum resonance frequency f0 can be lowered, and the low frequency sound output can be easily obtained. As a result, it becomes possible that the speaker device having the diaphragm obtains the high sensitivity to be preferably used as the speaker for the mobile phone.

In another embodiment of the present invention, the mobile phone including the above speaker device can be formed. Thereby, the thin and slim speaker device can be obtained.

The nature, utility, and further features of this invention will be more clearly apparent from the following detailed description with respect to preferred embodiment of the invention when read in conjunction with the accompanying drawings briefly described below.

DETAILED DESCRIPTION OF THE PREFERRED EMBODIMENTS

Now, preferred embodiments of the present invention will be described below with reference to the attached drawings. The speaker device according to each embodiment is a thin-type or slim-type (narrow-width-type) speaker device preferably usable for a receiver or a call-indicating part of a mobile phone, or for various kinds of electronic equipments for a mobile or a neighboring acoustic field.

First Embodiment (Configuration of Speaker Device)

Figure 1:
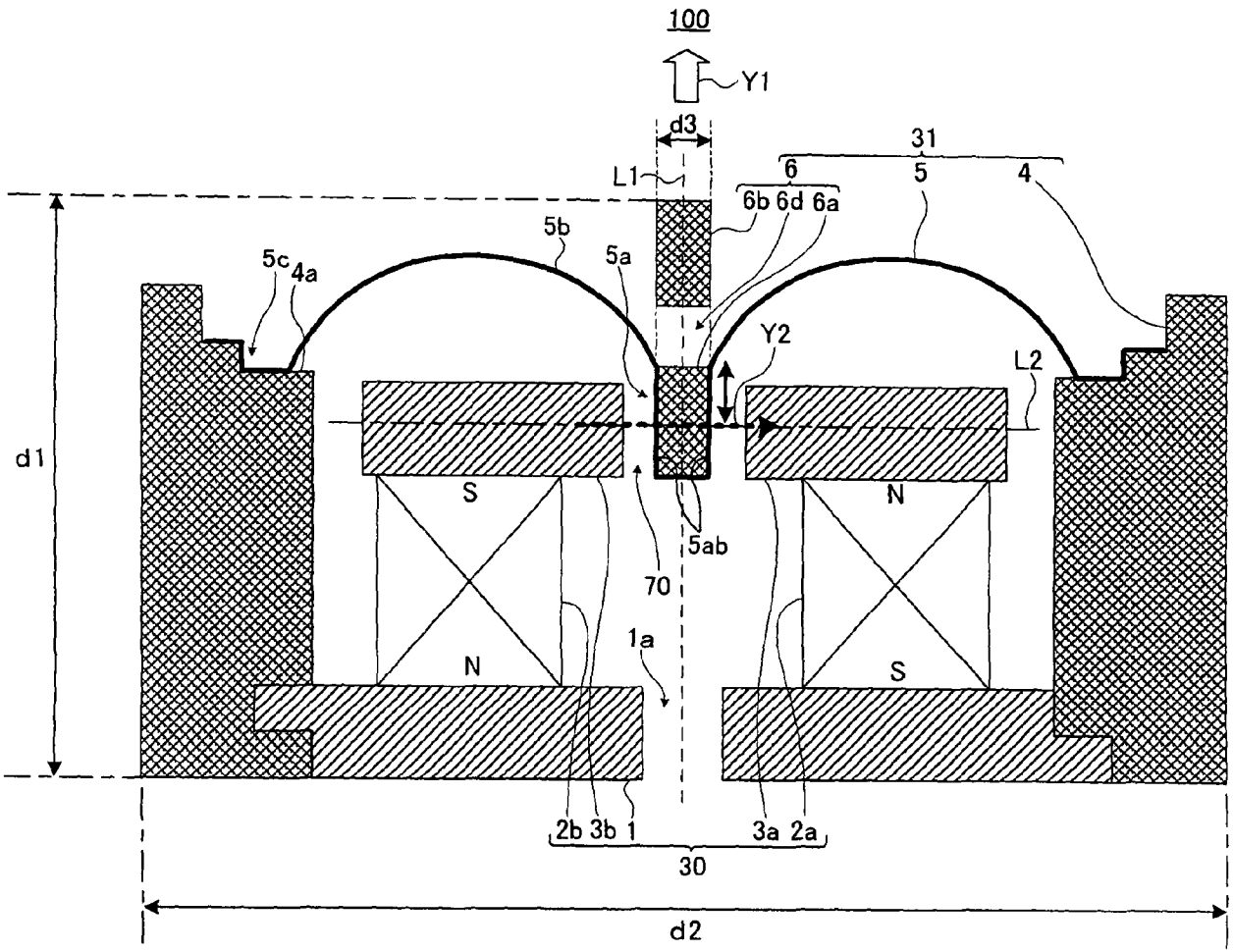
FIG. 1 is a cross-sectional view showing a configuration of a speaker device according to a first embodiment of the present invention.
Figure 2:
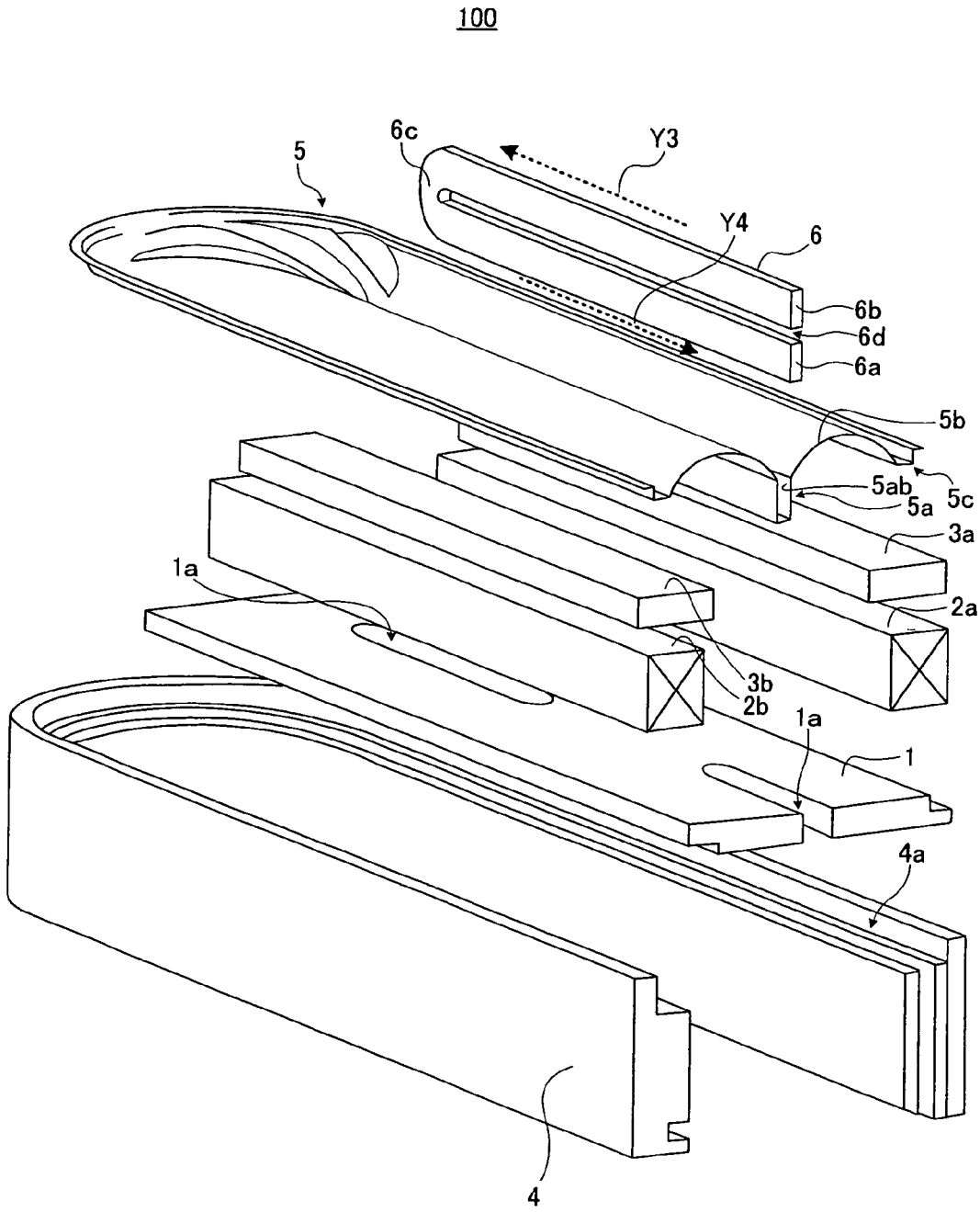
FIG. 2 is a one-side disassembly perspective view showing the configuration of the speaker device according to the first embodiment.

FIG. 1 schematically shows a cross-sectional configuration of a speaker device 100 according to a first embodiment of the present invention. In addition, FIG. 1 shows a cross-sectional view of the speaker device 100 when cut by a plane passing through a central axis L1 thereof. FIG. 2 shows a one-side disassembly perspective view of the speaker device 100 shown in FIG. 1 when cut by the central axis L1. Hereinafter, a description will be given of the configuration of the speaker device 100 according to the first embodiment of the present invention.

The speaker device 100 mainly includes an internal-magnet-type magnetic circuit 30 having a yoke 1, a pair of magnets 2*a* and 2*b* and a pair of plates 3*a* and 3*b*, a frame 4, and a vibration system 31 having a diaphragm 5 and a voice coil 6. Hereinafter, for convenience of explanation, when each of the magnets and/or each of the plates are distinguished, they are individually expressed, like "magnet 2*a*" and "plate 3*a*". Meanwhile, when they are not particularly distinguished, they are expressed as the magnet 2 and the plate 3.

First, a configuration of the magnetic circuit 30 will be explained.

The yoke 1, having plural openings 1*a*, is formed into a flat plate shape and a substantially rectangular plane shape. Each of the openings 1*a* has a function to outwardly output the unnecessary air in the speaker device 100 to the outside thereof at the time of movement of the diagram 5 to the side of the yoke 1. Thereby, it can be prevented that the pressure (i.e., back pressure) in the speaker device 100 becomes high.

Each of the pair of magnets 2*a* and 2*b* is formed into rectangular parallelepiped shape and an angular pole shape. The relative size and magnetic force of the magnets 2*a* and 2*b* are same. On the yoke 1, the magnets 2*a* and 2*b* are provided at positions opposite to each other with a constant space therebetween. A positional relation of an S-pole and an N-pole of one of the pair of the magnets 2*a* and 2*b* is reverse to the positional relation of the S-pole and the N-pole of the other one of the pair of the magnets 2*a* and 2*b* with respect to the vibration direction of the diaphragm 5. Concretely, the lower surface of the magnet 2*a*, neighboring to the yoke 1, is magnetized to the S-pole, and the upper surface of the magnet 2*a*, neighboring to the plate 3*a*, is magnetized to the N-pole. Correspondently, the lower surface of the magnet 2*b*, neighboring to the yoke 1, is magnetized to the N-pole, and the upper surface of the magnet 2*b*, neighboring to the plate 3*b*, is magnetized to the S-pole. In the present invention, the relative positional relation in the magnetization state between the S-pole and the N-pole of the magnets 2*a* and 2*b* is not limited to the configuration.

Each of the pair of plates 3*a* and 3*b* is formed into a flat plate shape. The length in the longitudinal direction of each of the plates 3*a* and 3*b* is set to the substantially same length as that in the longitudinal direction of the magnet 2. The plate 3*a* is mounted on the magnet 2*a*, and the plate 3*b* is mounted on the magnet 2*b*. The plates 3*a* and 3*b* are opposite to each other with a constant space, and a constant gap is formed therebetween.

In the magnetic circuit 30 having the above-mentioned configuration, the magnetic flux of the magnets 2*a* and 2*b* is concentrated in the gap. Namely, a magnetic gap 70 is formed between the plates 3*a* and 3*b*. The magnetic gap 70 is formed at a substantially central position of the magnetic circuit 30. The direction of the magnetic flux (magnetism) generated in the magnetic gap 70 is set to the direction of an arrow Y2.

Next, the frame 4 will be explained. The frame 4 is formed into a cylindrical shape. When planarly observed, the frame 4 is formed into an elongated circular or ellipse shape and an annular (ring) shape. On the upper end surface of the frame 4, a step part 4*a* formed into a step state, supporting an outer peripheral portion of the diaphragm 5, is provided. The yoke 1 is mounted on the lower end portion of the frame 4, and the frame 4 houses the magnetic circuit 30.

Next, a description will be given of a configuration of the vibration system 31.

The diaphragm 5 is formed into an elongated circular or ellipse plane shape. Additionally, the diaphragm 5 has a recessed part 5*a* arranged at a central position thereof and extending in the longitudinal direction, a sound output part 5*b* arranged around the recessed part 5*a* and having a semicircle cross-section, and a step part 5*c* provided in an outer peripheral portion of the sound output part 5*b* and having a cross-section formed into a step state.

The sound output part 5*b*, occupying a major part of the entire area of the diaphragm 5, outputs the sound and has a function of an edge for absorbing the unnecessary vibration at the time of the sound reproduction. In addition, the length in the lateral direction of the sound output part 5*b* occupies the major part of the length of the lateral direction of the diaphragm 5. The recessed part 5*a*, which is formed into an elongated shape and a sack-like or U-shaped cross-section, extends in the direction in parallel with the direction substantially orthogonal with respect to the arrow Y2 direction being the magnetic flux direction. The recessed part 5*a* is arranged in the vicinity of the central axis L1 of the speaker device 100, i.e., at the substantially central position in the magnetic circuit 30. The recessed part 5*a*, at which a first parallel part 6*a* of the voice coil 6 is arranged, supports the voice coil 6. The step part 5*c* of the diaphragm 5 becomes engaged with the step part 4*a* of the frame 4. Thereby, the diaphragm 5 is supported by the frame 4, and the first parallel part 6*a* of the voice coil 6, which is arranged in the recessed part 5*a* of the diaphragm 5, is arranged in the magnetic gap 70 provided between the pair of plates 3*a* and 3*b*.

The voice coil 6, including a pair of lead wires (not shown) having a plus lead wire and a minus lead wire, is wound to have a plane shape in an elongated circular and ring shape. The plus lead wire is input wiring of an L(or R)-channel signal, and the minus lead wire is input wiring of a ground (GND) signal. Each of the lead wires is electrically connected to each output wiring of an amplifier (not shown). Therefore, a signal and power (hereinafter, simply referred to as "sound current", too) are inputted to the voice coil 6 from the amplifier via each of the lead wires, respectively.

Moreover, the voice coil 6 includes the first parallel part 6*a* extending in one direction, a second parallel part 6*b*, arranged opposite to the first parallel part 6*a* with a constant gap 6*d* and extending in a direction in parallel with the first parallel part 6*a*, and plural connection parts 6*c* connecting each end of the first parallel part 6*a* and each correspondent end of the second parallel part 6*b*. The voice coil 6 is arranged in the recessed part 5*a* of the diaphragm 5.

The length in the longitudinal direction of the first parallel part 6*a* is set to the substantially same length as the length in the longitudinal direction of the recessed part 5*a* of the diaphragm 5. The first parallel part 6*a*, which is arranged in the recessed part 5*a* of the diaphragm 5, is sandwiched and fixed by side surfaces 5*ab* of the recessed part 5*a*. The length in the longitudinal direction of the second parallel part 6*b* is set to the substantially same length as the length in the longitudinal direction of the first parallel part 6*a*. In addition, a constant gap 6*d* is formed between the first parallel part 6*a* and the second parallel part 6*b*, and the second parallel part 6*b* is positioned above the recessed part 5*a* and on the sound output side of the diaphragm 5. In a preferred example, it is preferred that the positional relation between the first parallel part 6*a* and the second parallel part 6*b* is prescribed so that the second parallel part 6*b* is positioned in the magnetic gap 70 when the excessive sound current is inputted to the voice coil 6 and the voice coil 6 largely vibrates in the direction opposite to the sound output direction Y1 of the diaphragm 5.

In the voice coil 6 having the configuration, since the sound current flows in a circular manner, the direction of the sound current flowing in the first parallel part 6*a* and the direction of the sound current flowing in the second parallel part 6*b* relatively become opposite, as shown in FIG. 2. Namely, in FIG. 2, when the sound current is assumed to flow in the arrow Y4 direction in the first parallel unit 6*a*, the sound current flows in the arrow Y3 direction opposite to the arrow Y4 direction in the second parallel part 6*b*.

In the above-mentioned speaker device 100, the sound current outputted from the amplifier is inputted to the voice coil 6 via each of the lead wires of the voice coil 6. Thereby, the driving force is generated at the first parallel part 6*a* of the voice coil 6 in the magnetic gap 70, and the first parallel part

6*a* vibrates in the direction of the central axis L1 of the speaker device 100 with respect to the central axis L2 in the thickness direction of the plates 3*a* and 3*b* within such a range that the second parallel part 6*b* is not positioned in the magnetic gap 70. In this manner, the speaker device 100 outputs the acoustic wave in the arrow Y1 direction via the sound output part 5*b* of the diaphragm 5.

The first embodiment having the above-mentioned configuration has characteristic operation and effect explained below.

First, in the speaker device 100 according to the first embodiment, the elongated recessed part 5*a* having the sack-like or U-shaped cross-section and extending in the longitudinal direction of the diaphragm 5 is provided at the central position in the lateral direction of the diaphragm 5. In the recessed part 5*a*, the first parallel part 6*a* of the voice coil 6 is arranged. Thereby, in FIG. 1, a center in the direction of a width d3 of the voice coil 6 can be coincident with a center of the lateral direction of the diaphragm 5, and the relative positional relation between the voice coil 6 and the diaphragm 5 can be set in an appropriate state.

In addition to the configuration, the recessed part 5*a* at which the first parallel part 6*a* is arranged is arranged to be housed into the substantially central position in the magnetic circuit 30 and to be positioned in the magnetic gap 70 provided in the magnetic circuit 30. Thereby, the first parallel part 6*a* of the voice coil 6 is arranged at a position in the vicinity of the yoke 1. As a result, it becomes possible to reduce a height d1 of the speaker device 100 corresponding to the vibration direction of the diaphragm 5 and the voice coil 6. Thereby, the thin-type speaker device can be formed.

Additionally, the recessed part 5*a* of the diaphragm 5 is formed to extend in the direction substantially orthogonal with respect to the extending direction Y2 of the magnetic flux. The first parallel part 6*a* and the second parallel part 6*b* are arranged in the direction in parallel with the extending direction of the recessed part 5*a*, respectively. The first parallel part 6*a* is arranged in the recessed part 5*a*. Therefore, a width d2 in the lateral direction of the speaker device 100 can be reduced, and the speaker device 100 can be slim. In addition, the diaphragm 5 is formed into the elongated circular or ellipse plane shape. The recessed part 5*a* of the diaphragm 5, which is formed into the elongated and sack-like or U-shaped cross-section, is arranged at the substantially central position of the diaphragm 5 and the magnetic circuit 30. Therefore, this point can make the speaker device 100 slim.

Therefore, the speaker device 100 can be preferably used as the speaker device for the receiving part and/or for the call-indicating part of the mobile phone recently becoming thinner and slimmer. The speaker device 100 according to the first embodiment, which can be thin and slim, can be preferably used for various kinds of electronic equipments for the above-mentioned mobile or neighboring acoustic field, other than the speaker device for the mobile phone, too.

The first parallel part 6*a* of the voice coil 6 is sandwiched and fixed by the side surfaces 5*ab* of the recessed part 5*a* of the diaphragm 5. Thereby, the voice coil 6 is stably retained by the recessed part 5*a*, and it becomes possible to overcome the disadvantage of easily bending in the vibration direction of the voice coil 6, i.e., in the direction of the central axis L1 of the speaker device 100. Thereby, the voice coil 6 hardly bends in the direction of the central axis L1 being the vibration direction thereof. Thus, the first parallel part 6*a* can be appropriately positioned in the magnetic gap 70. Moreover, since the step part 5*c* provided at the outer peripheral portion of the diaphragm 5 is made engaged with the step part 4*a* of the frame 4, the center in the lateral direction of the diaphragm 5, i.e., the center in the width direction of the recessed part 5*a*, can be substantially coincident with the central axis L1 of the speaker device 100. Thereby, the center in the direction of the width d3 of the voice coil 6 can be substantially coincident with the central axis of the frame 4, the diaphragm 5 and the magnetic circuit 30, i.e., the central axis L1 of the speaker device 100. As a result, the diaphragm 5 can be smoothly and stably moved at the time of the sound reproduction, and the strength of the entire vibration system 31 can be sufficiently ensured.

In addition, the second parallel part 6*b* of the voice coil 6 is arranged above the first parallel part 6*a* and on the sound output side of the diaphragm 5 with the constant gap 6*d*. Therefore, even when the excessive sound current is inputted to the voice coil 6 due to any cause and the voice coil 6 and the diaphragm 5 largely moves to the direction opposite to the sound output direction Y1 of the speaker device 100 at the time of the driving of the speaker device 100, contact or collision between a part in the vicinity of the recessed part 5*a* of the diaphragm 5 and the plate 3*a* and/or the plate 3*b* can be avoided by interaction between the magnetic flux formed in the magnetic gap 70 and the first and second parallel parts 6*a* and 6*b*. This point will be explained in detail, with reference to FIG. 1 to FIG. 3.

Figure 3:
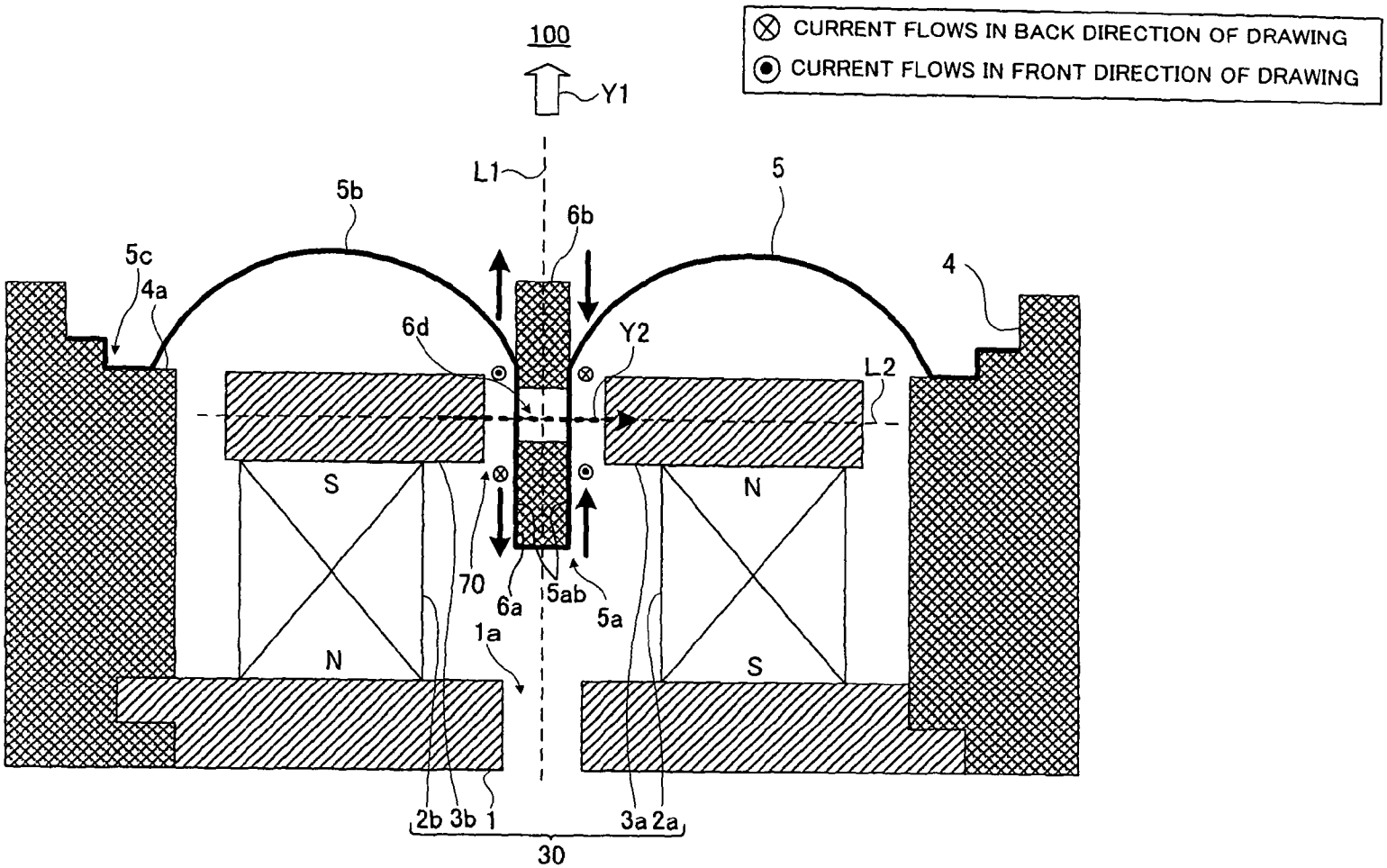
FIG. 3 is a cross-sectional view for explaining a driving principle of the speaker device according to the first embodiment.

FIG. 3 is a cross-sectional view of the speaker device 100, corresponding to FIG. 1, and a cross-sectional view for explaining the driving method of the speaker device 100.

First, when the sound current flows to the back side or the front side of the drawing in the first parallel part 6*a* of the voice coil 6 shown in FIG. 1, the first parallel part 6*a* vibrates in the direction of the central axis L1 of the speaker device 100 with respect to the central axis L2 in the thickness direction of the plates 3*a* and 3*b* within such a range that the second parallel part 6*b* is not positioned in the magnetic gap 70, in accordance with Fleming's left-hand rule. Thereby, the acoustic wave is outputted in the direction of the arrow Y1 via the sound output part 5*b* of the diaphragm 5.

However, if the excessive sound current is inputted to the voice coil 6 due to any cause and the voice coil 6 largely moves to the side of the yoke 1 opposite to the sound output direction, the center in the thickness direction of the gap 6*d* provided between the first parallel part 6*a* and the second parallel part 6*b* substantially coincides with the central axis L2 in the thickness direction of the plate 3. Thereby, in the magnetic gap 70, the driving forces of the same amount in the relatively opposite direction operate on the first parallel part 6*a* and the second parallel part 6*b*. Namely, since the sound current flows to the back side of the drawing at the first parallel part 6*a* at this time, the driving force operates on the side opposite to the sound output direction Y1 at the first parallel part 6*a*. Meanwhile, since the sound current flows to the front side of the drawing at the second parallel part 6*b*, the driving force of the same amount as that of the first parallel part 6*a* operates on the sound output direction Y1 at the second parallel part 6*b*. In such a state, subsequently at the next moment, since the sound current flows to the front side of the drawing at the first parallel part 6*a*, the driving force operates on the sound output direction Y1 at the first parallel part 6*a*. Meanwhile, since the sound current flows to the back side of the drawing at the second parallel part 6*b*, the driving force of the same amount as that of the first parallel part 6*a* operates on the side opposite to the sound output direction Y1 at the second parallel part 6*b*. Therefore, the driving force occurring to the first parallel part 6*a* and the driving force of the same amount in the opposite direction, occurring to the second parallel part 6*b*, temporarily and instantly collide with each other, and the voice coil 6 does not move to the side of the yoke 1 with respect to the position any more. Namely, the movement of the voice coil 6 to the side of the yoke 1 is limited from the position. Since the diaphragm 5 has the elastic force for returning to the initial position, the voice coil 6 never stays at the position. When the appropriate sound current is inputted to the voice coil 6, the voice coil 6 gets back to the above-mentioned appropriate vibration state by the elastic force at the next moment. By the operation, it can be prevented that the part in the vicinity of the recessed part 5*a* of the diaphragm 5 and the plate 3*a* and/or the plate 3*b* contact or collide with each other. Therefore, at the time of the large magnitude movement on the side opposite to the sound output direction Y1 of the voice coil 6, the second parallel part 6*b* has a function to temporarily and instantly stop the movement of the voice coil 6 in the direction, i.e., a function of a brake (stopper). This point can make the speaker device 100 thin, too.

Further, in the speaker device 100 according to the first embodiment, the minimum resonance frequency f0 can be lowered by the configuration of the diaphragm 5, as compared with a comparative example explained below. Therefore, it is advantageous that the low frequency sound output can be easily realized and the speaker device 100 is preferably usable as the speaker for the mobile phone or which the high sensitivity is necessary.

Figure 4:
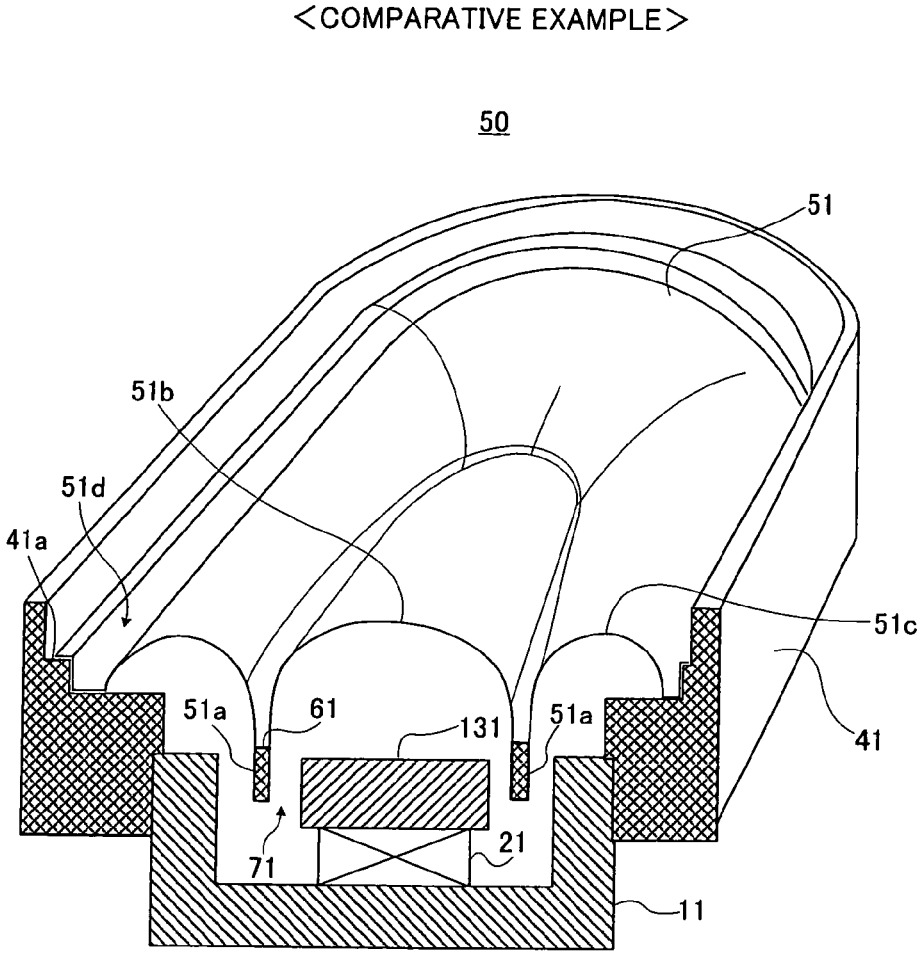
FIG. 4 is a cross-sectional view showing a configuration of a speaker device according to a comparative example.

First, a description will be given of a configuration of a speaker device according to the comparative example, with reference to FIG. 4. FIG. 4 shows a one-side perspective view of a speaker device 50 according to the comparative example.

The speaker device 50 according to the comparative example includes a magnetic circuit including a yoke 11 having an elongated circular or ellipse plane surface and a recessed cross-section; a magnet 21 mounted on the middle position on the yoke 11 and formed into a rectangular parallelepiped shape and angular pole shape; and a flat plate 131 mounted on the magnet 21 and having the substantially same length as that in the longitudinal direction of the magnet 21, a frame 41 having a shape similar to that of the first embodiment, a vibration system including a diaphragm 51 supported by the frame 41; and a voice coil 61 supported by the diaphragm 51.

In the magnetic circuit, an upper end part of the yoke 11 and the plate 131 are opposite to each other with a constant space, and a magnetic gap 71 is formed therebetween.

The frame 41 is mounted in the vicinity of the upper end part of the yoke 11. A step part 41*a* having a step shape is provided at an outer peripheral portion on the side of the upper end part of the frame 41.

The diaphragm 51, having a function to output the sound, includes a sound output part 51*b* having a semicircle cross-section, an edge 51*c* provided around the sound output part 51*b* with a constant space and having an Ω-shaped cross-section, a recessed part 51*a* provided between the sound output part 51*b* and the edge 51*c* and having a recessed cross-section, and a step part 51*d* provided at an outer peripheral edge portion of the edge 51*c* and having a step-state cross-section. The step part 51*d* of the diaphragm 51 becomes engaged with the step part 41*a* of the frame 41. Thereby, the sound output part 51*b* is arranged at a position covering the plate 131, and the recessed part 51*a* is arranged in the magnetic gap 71. The voice coil 61 wound in a ring state is arranged in the recessed part 51*a*; Therefore, the voice coil 61 is positioned in the magnetic gap 71. In the comparative example, when the sound current is inputted to the voice coil 61, the driving force occurs to the voice coil 61 in the magnetic gap 71, and the acoustic wave is outputted from the sound output part 51*b* of the diaphragm 51.

In the comparative example having the above-mentioned configuration, since the edge width becomes small by the configuration, which will be explained later, the position of the voice coil 61 is away from a central position of the speaker device 50. Thereby, there is such a problem that the minimum resonance frequency f0 becomes higher and the low frequency sound is hardly obtained, as compared with the first embodiment. Thus, the speaker device according to the comparative example is unusable as the speaker for the mobile phone for which the high sensitivity is necessary. This point will be explained with reference to FIGS. 5A and 5B, hereinafter.

Figure 5A:
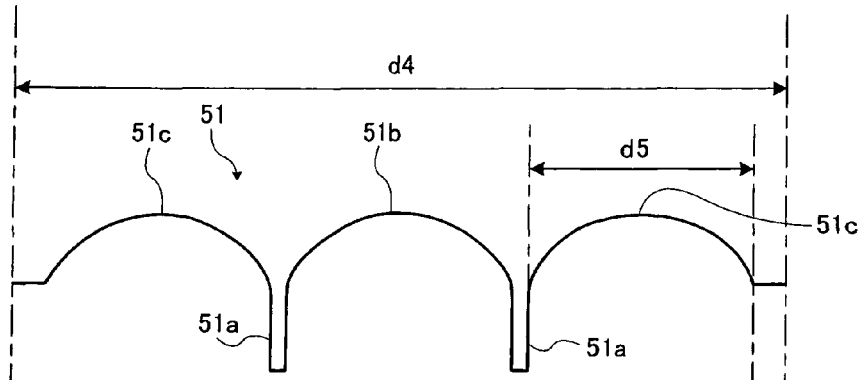
FIGS. 5A and 5B are cross-sectional views of a diaphragm for explaining operation and effect according to the first embodiment, as compared with the comparative example.
Figure 5B:
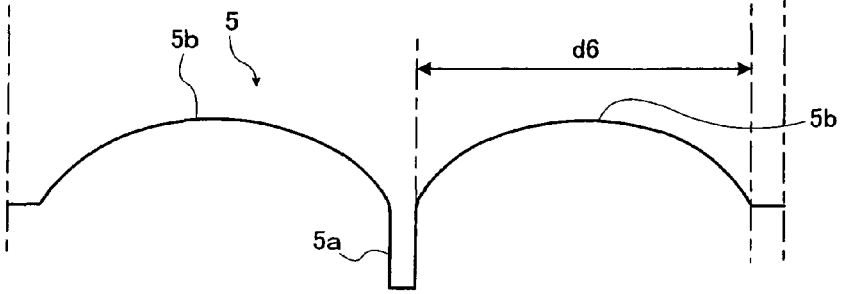

FIG. 5A is a cross-sectional view corresponding to the lateral direction of the diaphragm 51 according to the comparative example. Meanwhile, FIG. 5B is a cross-sectional view corresponding to the lateral direction of the diaphragm 5 according to the first embodiment.

The length (width) in the lateral direction of the diaphragm 51 according to the comparative example and the length (width) in the lateral direction of the diaphragm 5 according to the first embodiment are set to the same length d4, and the thicknesses of them are also set to the same (not shown). In the comparative example, the width of the edge 51*c* of the diaphragm 51 is set to d5. Meanwhile, the width of the sound output part 5*b* serving as the edge in the first embodiment is set to d6(>d5). Namely, it can be said that the edge width according to the first embodiment is larger than that of the comparative example. In addition, the length in the lateral direction of the sound output part 5*b* of the diaphragm 5 according to the first embodiment occupies the major part of the length in the lateral direction of the diaphragm 5. In this point, it can be said that the edge width is large. Generally, as the edge width becomes larger, the edge becomes softer. Therefore, the resonance frequency of the speaker device can be reduced, and the voice coil can be close to the central position of the speaker device. Thereby, since the minimum resonance frequency f0 can be lowered, the low frequency sound output can be easily obtained. In the first embodiment, as compared with the comparative example, the minimum resonance frequency f0 can be lowered, and the low frequency sound output can be easily obtained. As a result, the speaker device including the diaphragm 5 according to the first embodiment can obtain the high sensitivity, and it can be preferably used for the speaker of the mobile phone.

Second Embodiment

Figure 6:
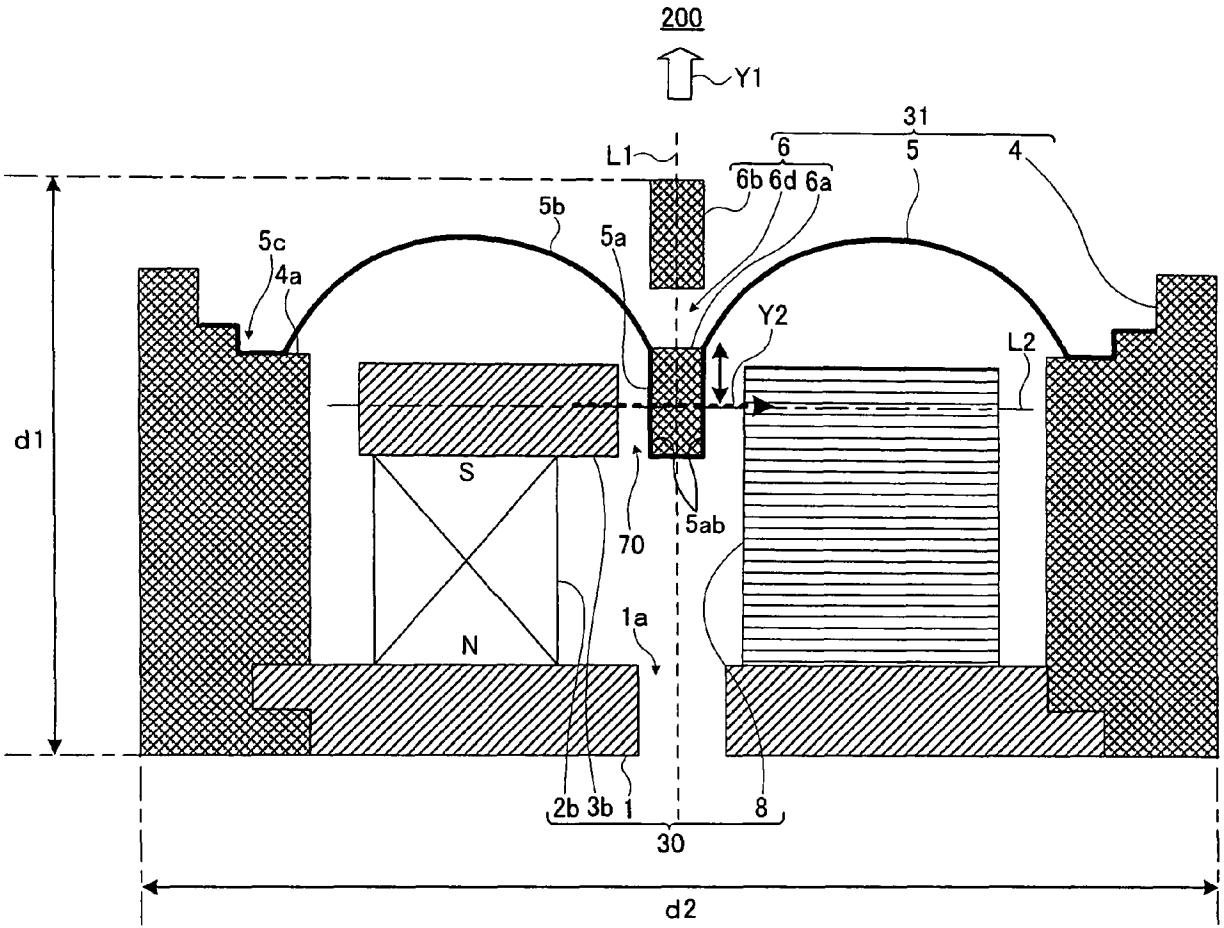
FIG. 6 is a cross-sectional view showing a configuration of a speaker device according to a second embodiment of the present invention.

Next, a description will be given of a configuration of a speaker device 200 according to a second embodiment of the present invention, with reference to FIG. 6. FIG. 6 shows a cross-sectional view of a speaker device 200 of the second embodiment when cut by a plane passing through the central axis L1. Hereinafter, the same reference numerals are given to the same components as those common with the first embodiment, and explanations thereof are simplified or omitted.

When the second embodiment is compared with the first embodiment, their configurations are substantially common. However, the number of magnets 2 and the number of plates 3 are different between the second embodiment and the first embodiment.

Concretely, though the speaker device 200 according to the second embodiment includes the magnet 2*b* and the plate 3*b*, it does not include the magnet 2*a* and the plate 3*a*. Instead, in the second embodiment, the speaker device 200 includes a magnetic body 8 at the position corresponding to the magnet 2*a* and the plate 3*a*. In a preferred example, the magnetic body 8 can be made of a metallic member such as iron. The magnetic body 8 has the same length as the length in the longitudinal direction of the magnet 2*b*, and the thickness (height) of the magnetic body 8 is set to the sum of the thickness (height) of the magnet 2*b* and the thickness (height) of the plate 3*b*. Therefore, the vicinity of the upper end portion of the inner wall of the magnetic body 8 and the plate 3*a* are opposite to each other with the constant space, and the magnetic gap 70 is formed therebetween. In the second embodiment, the direction of the magnetic flux occurs in the direction of the arrow Y2, similarly to the first embodiment. In the second embodiment, according to the same principle as that of the first embodiment, the acoustic wave is outputted in the direction of the arrow Y1 via the sound output part 5*b* of the diaphragm 5.

The second embodiment having the above-mentioned configuration has characteristic operation and effect described below.

Generally, when the number of magnets and the number of plates become small, the sensitivity is lowered by the amount. However, according to the specification of the electronic equipments on which the speaker device is loaded, the high sensitivity and efficiency are not always necessary. For example, as the speaker device used for the mobile phone, there are speakers of two kinds, i.e., for the receiver part and for the call-indicating part. In the case of the speaker device for the receiver, the priorities of the miniaturization and lowering the minimum resonance frequency f0 (low f0) are high as the specification, but the high sensitivity and efficiency are not necessary so much. Thus, in this case, in consideration of the manufacturing cost, it is preferred to apply not the speaker device according to the first embodiment but the speaker device according to the second embodiment, as the receiver of the mobile phone, for example. Namely, as the speaker device preferable for the mobile phone for which the high sensitivity and efficiency are necessary, it is preferable to apply, instead of the speaker device 100 according to the first embodiment, the speaker device 200 according to the second embodiment, whose manufacturing cost is lower by the amount in spite of the slightly inferior sensitivity and efficiency because of the smaller number of magnets, as compared with the speaker device 100 according to the first embodiment. The other operation and effect according to the second embodiment are substantially same as those of the first embodiment.

Third Embodiment

Figure 7:
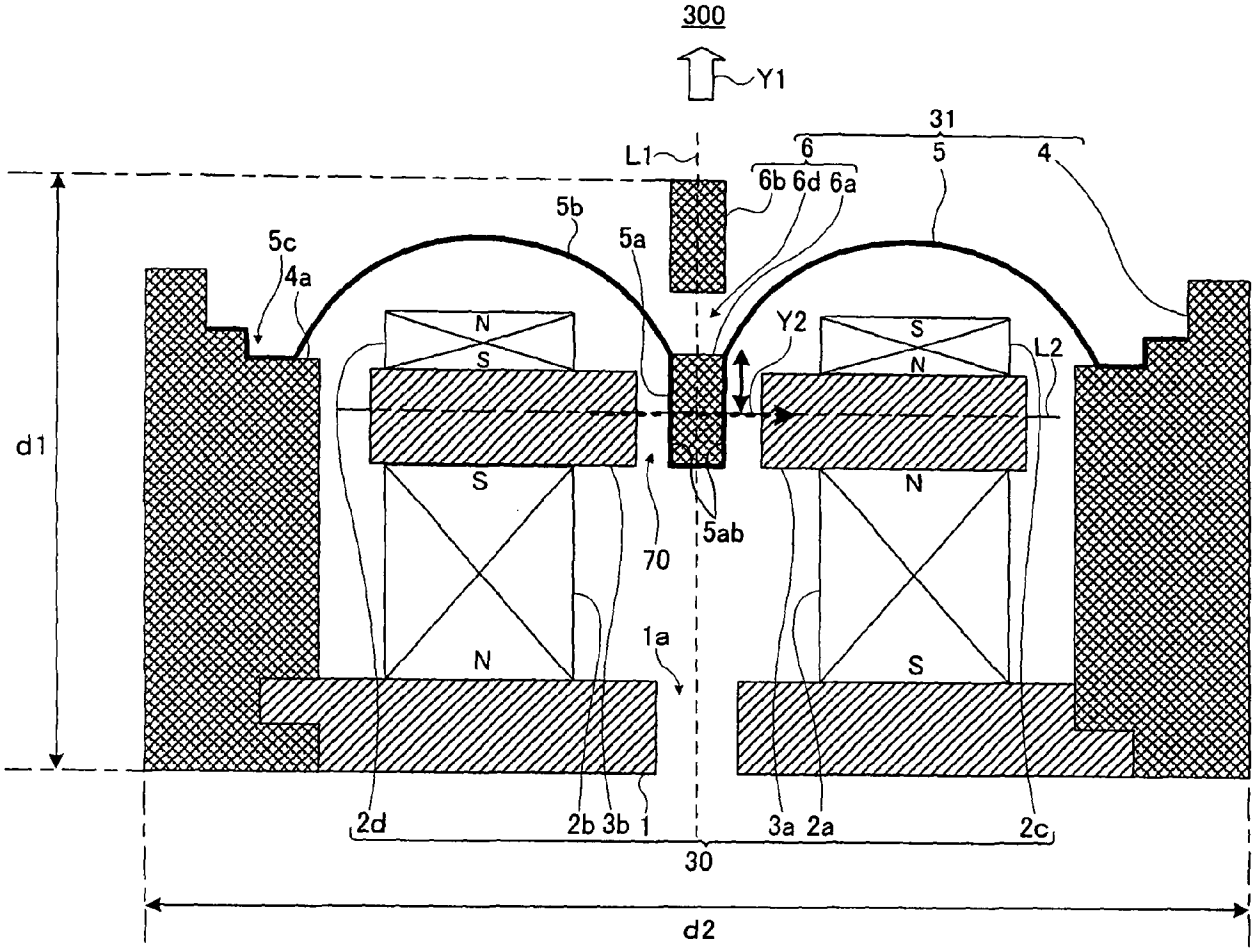
FIG. 7 is a cross-sectional view showing a configuration of a speaker device according to a third embodiment of the present invention.

Next, a description will be given of a configuration of a speaker device 300 according to a third embodiment of the present invention, with reference to FIG. 7. FIG. 7 shows a cross-sectional view of the speaker device 300 according to the third embodiment when cut by a plane passing through the central axis L1. Hereinafter, the same reference numerals are given to the components common with those of the first embodiment, and explanations thereof are simplified or omitted.

When the third embodiment and the first embodiment are compared, their configurations are substantially common. However, the number of magnets in the third embodiment is larger than that of the first embodiment.

Concretely, the speaker device 300 according to the third embodiment further includes the pair of magnets 2*c* and 2*d* in addition to the pair of magnets 2*a* and 2*b*. In the present invention, in consideration of the manufacturing cost or in accordance with the specification, the speaker device 300 may include the magnet 2*c*or 2*d*. The magnet 2*c* is mounted on the plate 3*a*, and the magnet 2*d* is mounted on the plate 3*b*. The positional relation of an S-pole and an N-pole of one of the pair of the magnets 2*c* and 2*d* is reverse to the positional relation of the S-pole and the N-pole of the other one of the pair of the magnets 2*a* and 2*b*, opposite to each other and sandwiching the corresponding plates 3*a* and 3*b*, with respect to the vibration direction of the diaphragm 5, respectively.

Concretely, the lower surface of the magnet 2*c*, adjacent to the plate 3*a*, is magnetized to the N-pole, and the lower surface of the magnet 2*d*, adjacent to the plate 3*b*, is magnetized to the S-pole. Therefore, the lower surface of the magnet 2*c*, magnetized to the N-pole, and the upper surface of the magnet 2*a*, magnetized to the N-pole, are opposite to each other with sandwiching the plate 3*a*. The lower surface of the magnet 2*d*, magnetized to the S-pole, and the upper surface of the magnet 2*b*, magnetized to the S-pole, are opposite to each other with sandwiching the plate 3*b*. In this manner, since the magnets 2*c* and 2*d* are arranged at the positions reacting against the magnets 2*a* and 2*b*, respectively, they are generally referred to as "reacting magnets".

In the third embodiment, in addition to the pair of magnets 2*a* and 2*b*, the magnets 2*c* and 2*d* are further provided as the reacting magnets. Therefore, by the amount of those reacting magnets, the magnetic power in the magnetic field in the magnetic gap 70 can be large. Thereby, the sensitivity and efficiency can be enhanced. In addition, when the excessive sound current is inputted to the voice coil 6 due to any cause and the voice coil 6 largely moves to the direction opposite to the sound output direction Y1, the function as the stopper for temporarily and instantly stopping the movement of the voice coil 6 to the direction can be further enhanced than that of the first embodiment. As a result, as compared with the first embodiment, it can be surely prevented that the part in the vicinity of the recessed part 5*a* of the diaphragm 5 and the plates 3*a* and 3*b* contact or collide. The other operation and effect of the third embodiment are substantially same as those of the first embodiment.

Fourth Embodiment

Figure 8:
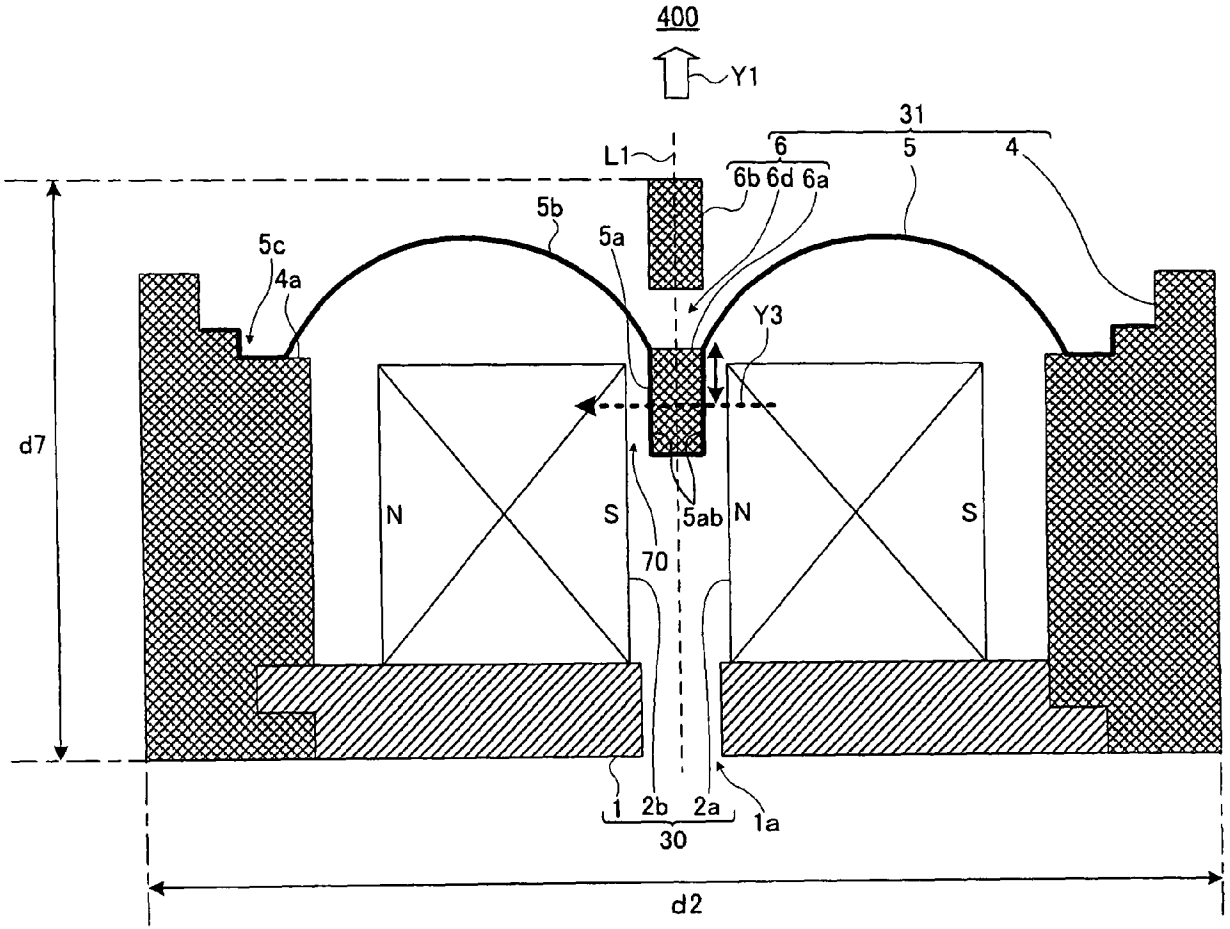
FIG. 8 is a cross-sectional view showing a configuration of a speaker device according to a fourth embodiment of the present invention.

Next, a description will be given of a configuration of a speaker device 400 according to a fourth embodiment of the present invention, with reference to FIG. 8. FIG. 8 shows a cross-sectional view of the speaker device 400 of the fourth embodiment when cut by a plane passing through the central axis L1. Hereinafter, the same reference numerals are given to the components common with those of the first embodiment, and explanations thereof are simplified or omitted.

When the fourth embodiment and the first embodiment are compared, their configurations are substantially common. However, as understood by comparing them, they are different in a point described below.

Namely, the speaker device 400 according to the fourth embodiment does not include the pair of plates 3*a* and 3*b*. In addition, in the first embodiment, the positional relation of an S-pole and an N-pole of one of the pair of the magnets 2*a* and 2*b* is reverse to the positional relation of the S-pole and the N-pole of the other one of the pair of the magnets 2*a* and 2*b* with respect to the vibration direction of the diaphragm 5. However, in the fourth embodiment, the positional relation of an S-pole and an N-pole of one of the pair of the magnets 2*a* and 2*b* is reverse to the positional relation of the S-pole and the N-pole of the other one of the pair of the magnets 2*a* and 2*b* with respect to the extending direction of the magnetic flux.

Concretely, in the fourth embodiment, the outer wall of the magnet 2*a*, opposite to the inner wall of the frame 4, is magnetized to the S-pole, and the outer wall of the magnet 2*b*, opposite to the inner wall of the frame 4, is magnetized to the N-pole. Therefore, the inner wall of the magnet 2*a*, opposite to the magnet 2*b*, is magnetized to the N-pole, and the inner wall of the magnet 2*b*, opposite to the magnet 2*a*, is magnetized to the S-pole. In the present invention, the positional relation of the S-pole and the N-pole of the magnets 2*a* and 2*b* is not limited to the configuration. The magnetic gap 70 is formed between the vicinity of the upper end portion of the inner wall of the magnet 2*a* and the vicinity of the upper end portion of the inner wall of the magnet 2*b*. Thereby, the magnetic flux occurs in the direction of the arrow Y3, in the vicinity of the magnetic gap 70. In addition, the recessed part 5*a* of the diaphragm 5 on which the first parallel part 6*a* of the voice coil 6 is arranged is arranged in the magnetic gap 70 formed between the magnets 2*a* and 2*b*. In the fourth embodiment having the above-mentioned configuration, the acoustic wave is outputted in the direction of the arrow Y1 via the sound output part 5*b* of the diaphragm 5, in accordance with the same principle as that of the first embodiment.

Particularly, since the speaker device 400 according to the fourth embodiment does not include the pair of plates 3*a* and 3*b*, the sensitivity and efficiency slightly becomes smaller than those of the first embodiment by the amount. At the same time, the manufacturing cost can be reduced. Therefore, in consideration of the sensitivity, the efficiency and the manufacturing cost of the electronic equipments such as the mobile phone, the speaker device 400 according to the fourth embodiment can be preferably used as the speaker device for the receiver of the mobile phone, for example. In addition, in the present invention, in consideration of the sensitivity, the efficiency and the manufacturing cost, either the magnet 2*a* or 2*b* may be exchanged for the magnetic body made of a metallic material such as iron, in the configuration of the above-mentioned fourth embodiment. Additionally, in the fourth embodiment, since the pair of plates 3*a* and 3*b* are not provided, a height d7 of the speaker device 400, corresponding to the vibration direction of the diaphragm 5 and the voice coil 6, can be smaller, as compared with the first embodiment. Thus, the thinner speaker device can be realized. The other operation and effect of the fourth embodiment is substantially same as those of the first embodiment.

Fifth Embodiment

Figure 9:
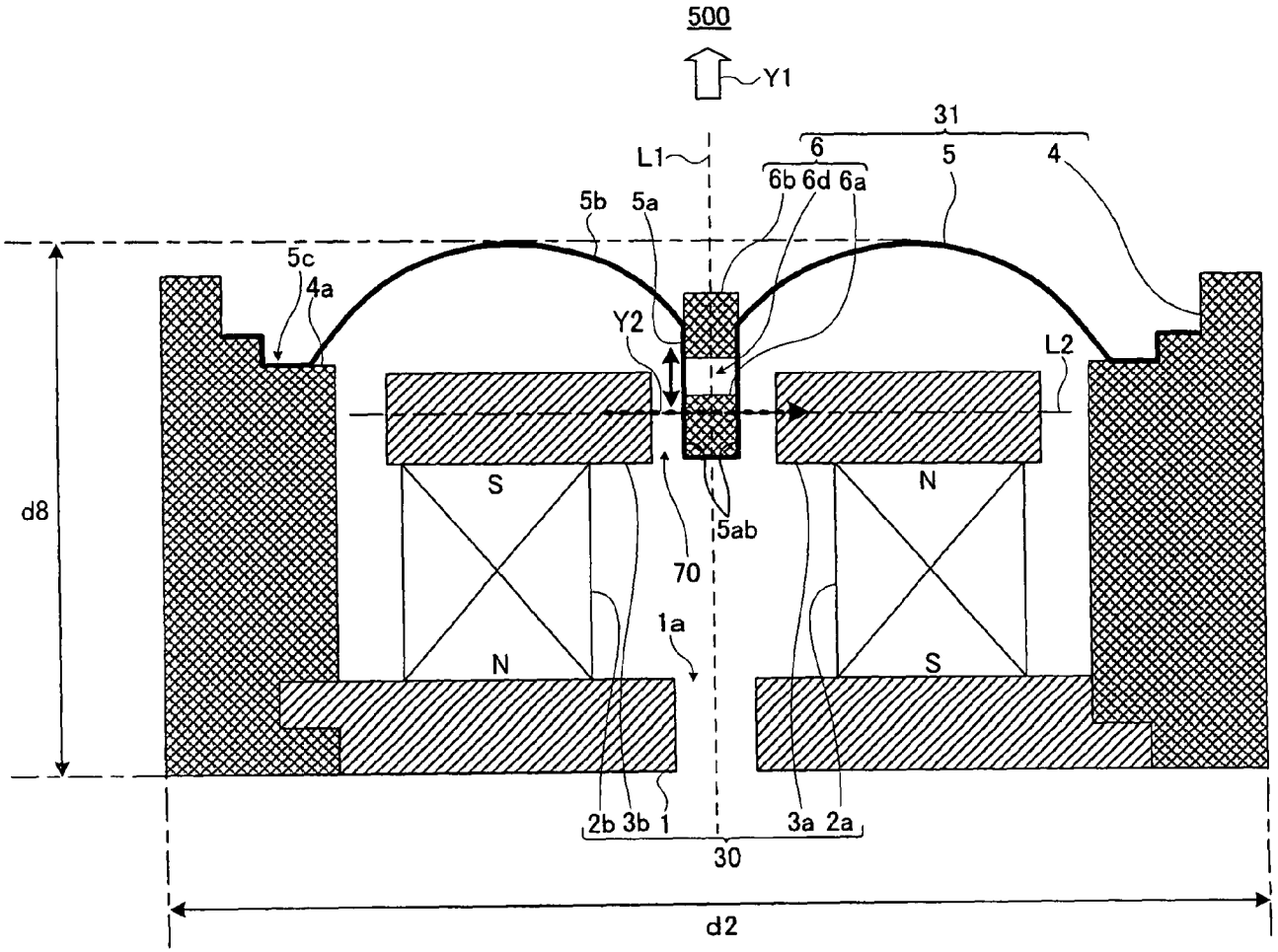
FIG. 9 is a cross-sectional view showing a configuration of a speaker device according to a fifth embodiment of the present invention.

Next, a description will be given of a configuration of a speaker device 500 according to a fifth embodiment of the present invention, with reference to FIG. 9. FIG. 9 shows a cross-sectional view of the speaker device 500 of the fifth embodiment when cut by a plane passing through the central axis L1. Hereinafter, the same reference numerals are given to the components common with those of the first embodiment, and explanations thereof are simplified or omitted.

When the fifth embodiment and the first embodiment are compared, their configurations are substantially common. However, as understood by comparing them, not only the first parallel part 6*a* of the voice coil 6 but also a part of the second parallel part 6*b* thereof are arranged in the recessed part 5*a* of the diaphragm 5 in the fifth embodiment. Then, the part of the second parallel part 6*b* is sandwiched and fixed by the side surfaces 5*ab* of the recessed part 5*a*.

In this manner, in the fifth embodiment, since not only the first parallel part 6*a* but also the second parallel part 6*b* are fixed to the recessed part 5*a* of the diaphragm 5, the improvement of the strength and stability at the time of the vibration of the vibration system 31 can be realized. The present invention is not limited to this configuration, and the entire first parallel part 6*a* and the entire second parallel part 6*b* may be arranged in the recessed part 5*a* in order to realize the above similar purpose.

Additionally, if this configuration is employed, the thinner speaker device 500 than the speaker device 100 in the first embodiment can be realized. Namely, though the height of the speaker device 100 in the first embodiment is set to the height d1 from the rear surface side of the yoke 1 to the upper surface side of the second parallel part 6*b* of the voice coil 6, the height of the speaker device 500 in the fifth embodiment is set to the height d8 (<d6) from the rear surface side of the yoke 1 to the top part on the sound output side of the sound output part 5*b* of the diaphragm 5. Therefore, as compared with the first embodiment, the thinner speaker device 500 can be realized in the fifth embodiment. The other operation and effect of the fifth embodiment are substantially same as those of the first embodiment.

Sixth Embodiment

Figure 10:
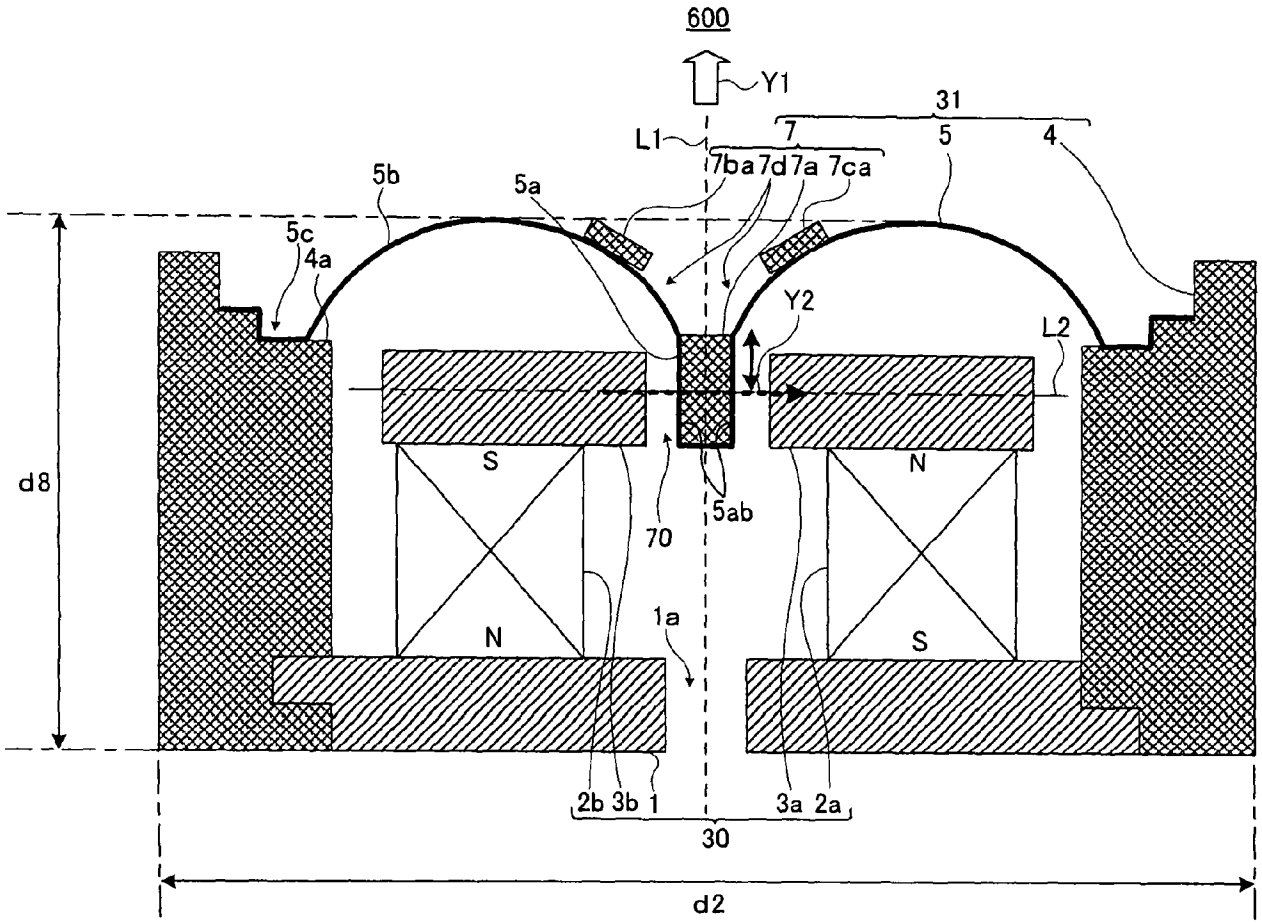
FIG. 10 is a cross-sectional view showing a configuration of a speaker device according to a sixth embodiment of the present invention.
Figure 11A:
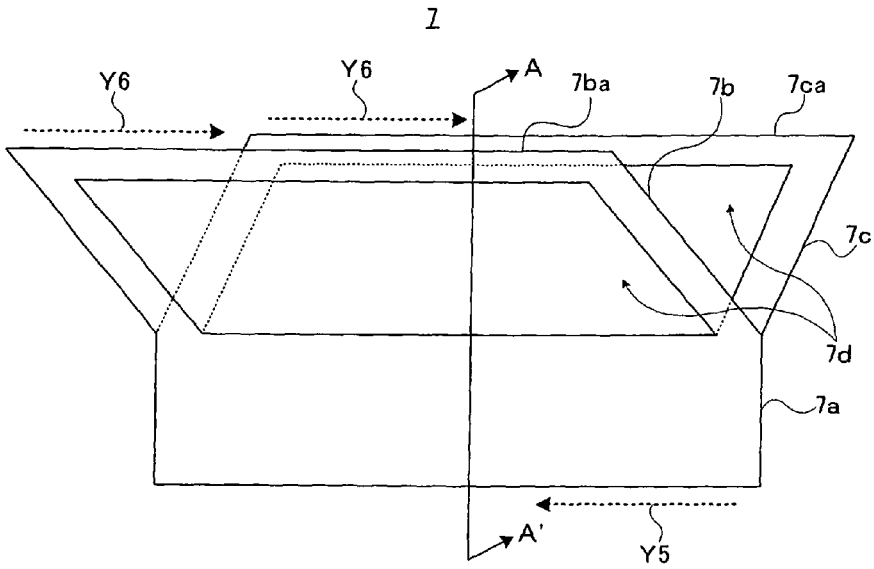
FIGS. 11A and 11B are a partly-cross-sectional view and a perspective view of a voice coil according to the sixth embodiment of the present invention.
Figure 11B:
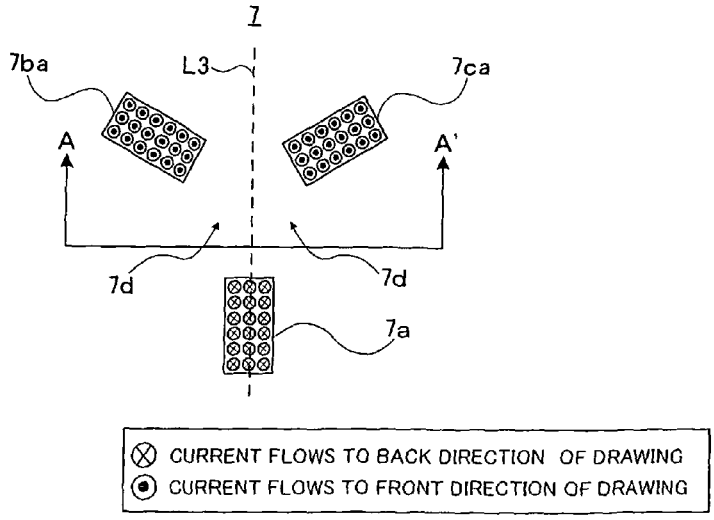

Next, a description will be given of a configuration of a speaker device 600 according to a sixth embodiment of the present invention, with reference to FIG. 10 and FIGS. 11A and 11B. FIG. 10 shows a cross-sectional view of the speaker device 600 in the sixth embodiment when cut by a plane passing through the central axis L1. FIG. 11A shows a perspective view schematically showing the configuration of the voice coil 7 according to the sixth embodiment. Meanwhile, FIG. 11B is a cross-sectional view taken along a cutting line A-A' of the voice coil 7 in FIG. 11A, particularly when cut by a plane passing through the lateral direction of the voice coil 7. Hereinafter, the same reference numerals are given to the components common with those of the first embodiment, and explanations thereof are simplified or omitted.

When the sixth embodiment and the first embodiment are compared, their configurations are substantially common. However, they are different in the configuration of the voice coil 7.

Concretely, the voice coil 7, including a pair of lead wires having a plus lead wire and a minus lead wire, is formed into a Y-shaped cross-section. The voice coil 7 has a first part 7*a* having a first parallel part of a rectangular shape and an angular pole shape extending in one direction, a second part 7*b* and a third part 7*c*, which are formed into a "U" shape, respectively. In the sixth embodiment, since the first part 7*a* is same as the first parallel part, the first part 7*a* is also referred to as "first parallel part 7*a*", hereinafter.

The first parallel part 7*a* has the substantially same length as the length in the longitudinal direction of the recessed part 5*a* of the diaphragm 5. The second part 7*b* has a second parallel part 7*ba* extending in the direction in parallel with the first parallel part 7*a*, and connected with the first parallel part 7*a* to form an annular shape. The third part 7*c* has a third parallel part 7*ca* arranged at a position symmetrical with the second parallel part 7*ba* with respect to the central line (the central axis L1 shown in FIG. 10 and the central line L3 shown FIG. 11B) passing through the center in the width direction of the first parallel part 7*a*. The width direction corresponds to the extending direction Y2 of the magnitude flux. The third parallel part 7*c* is connected with the first parallel part 7*a* to form an annular shape. By the above-mentioned configuration, an opening 7*d* formed into a substantially rectangular shape is formed between the first part 7*a* and the second part 7*b* and between the first part 7*a* and the third part 7*c*, respectively. In a preferred example, it is preferred that the positional relation between the first parallel part 7*a* and each of the second parallel part 7*ba* and the third parallel part 7*ca* is prescribed so that the second parallel part 7*ba* and the third parallel part 7*ca* are positioned in the magnetic gap 70, when the excessive sound current is inputted to the voice coil 7 and the voice coil 7 largely moves in the direction opposite to the sound output direction Y1 of the diaphragm 5.

In the voice coil 7, as shown in FIG. 11A, if the sound current is assumed to flow in the direction of the arrow Y5 in the first parallel part 7*a*, the sound current flows in the direction of the arrow Y6 opposite to the arrow Y5 in the second parallel part 7*ba* and the third parallel part 7*ca*, respectively (also see FIG. 11B). Namely, in the voice coil 7, the direction of the sound current flowing in the first parallel part 7*a* relatively becomes opposite to the direction of the sound current flowing in the second parallel part 7*ba* and the third parallel part 7*ca*.

Returning to FIG. 10, the first parallel part 7*a* of the voice coil 7 is arranged in the recessed part 5*a* of the diaphragm 5 provided in the magnetic gap 70, and is sandwiched and fixed by the side surfaces 5*ab* of the recessed part 5*a*. The second part 7*b* and the third part 7*c* of the voice coil 7 are fixed onto the sound output part 5*b* of the diaphragm 5, respectively. In this manner, in the sixth embodiment, the entire voice coil 7 is fixed to the diaphragm 5. As a result, the diaphragm 5 can be smoothly and stably moved at the time of the sound reproduction, and the low frequency sound output with high quality can be obtained. In addition, by the configuration, the height of the speaker device 600 becomes the height d8 from the rear surface of the yoke 1 to the top part of the sound output part 5*b* of the diaphragm 5. Thus, in the sixth embodiment, the thinner speaker device 600 can be realized, as compared with the first embodiment.

Additionally, in the sixth embodiment, when the excessive sound current is inputted to the voice coil 7 due to any cause, the voice coil 7 largely moves in the direction close to the yoke 1, similarly to the above first embodiment. At this time, when the central position of the opening 7*d* provided between the first parallel part 7*a* and each of the second parallel part 7*ba* and the third parallel 7*ca* substantially coincides with the central axis L2 in the thickness direction of each of the plates 3*a* and 3*b*, the driving force occurring to the first parallel part 7*a* temporarily and instantly balances with the driving force occurring to each of the second parallel part 7*ba* and the third parallel part 7*ca* having the same amount in the opposite direction. Then, the voice coil 7 does not move to the side of the yoke 1 from the position any more. Namely, the movement of the voice coil 7 to the side of the yoke 1 from the position is limited. Since the diaphragm 5 has the elastic force returning to the initial position, the voice coil 7 does not stay at the position. When the appropriate sound current is inputted to the voice coil 7, the voice coil 7 instantly returns to the above-mentioned appropriate vibration state by the elastic force. By the operation, similarly to the first embodiment, it can be prevented that the part in the vicinity of the recessed part 5*a* of the diaphragm 5 and the plate 3*a* and/or the plate 3*b* contact or collide. Therefore, at the time of the large vibration of the voice coil 7 in the direction opposite to the sound output direction Y1, the second parallel part 7*ba* and the third parallel part 7*ca* function to temporarily and instantly stop the movement of the voice coil 7 in the direction, i.e., serve as the stopper. This point can make the speaker device 600 thin, too. The other operation and effect of the sixth embodiment are substantially same as those of the first embodiment.

Modification

In the above-mentioned first to sixth embodiments, the entire first parallel part 6*a* of the voice coil 6 is arranged in the recessed part 5*a* of the diaphragm 5, but the present invention is not limited to this. In the present invention, the part of the first parallel part 6*a* of the voice coil 6 may be arranged in the recessed part 5*a* of the diaphragm 5.

Figure 12:
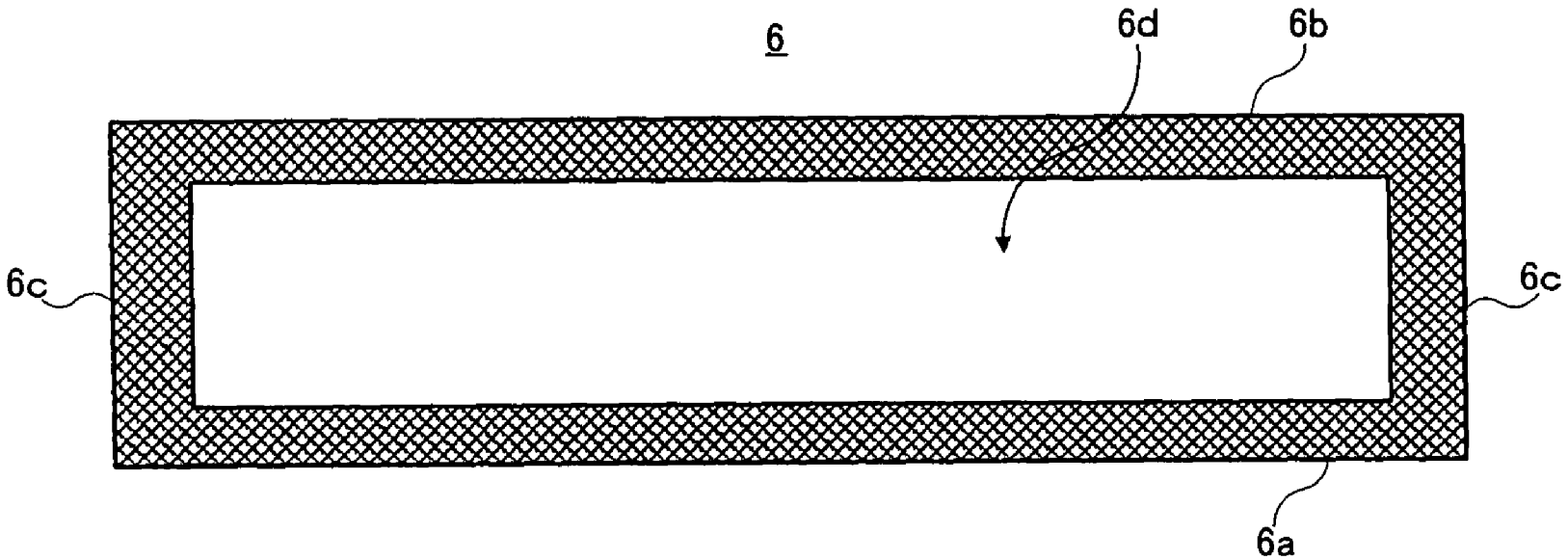
FIG. 12 is a plane view showing a configuration of a voice coil according to a modification.

In addition, in the above first to fifth embodiments, the plane shape of the voice coil 6 is formed into the elongated circular and ring state in order to become suitable for the shape of the speaker device, but the present invention is not limited to this. Namely, in correspondence to the shape of the speaker device, the shape of the voice coil 6 is variously deformable within the scope of the invention. For example, in correspondence to the shape of the speaker device, the voice coil 6 may be formed into an angular and rectangular shape and the plane shape thereof may be formed into the ring state, as shown in FIG. 12.

APPLICATION EXAMPLE TO MOBILE PHONE

Next, a description will be given of such an example that the speaker device 100 according to the first embodiment of the present invention is applied to a receiver part and a call-indicating part of the mobile phone. In the present invention, the speaker devices 200 to 600 according to the above second to sixth embodiments are applicable to the receiver part and the call-indicating part of the mobile phone.

Figure 13:
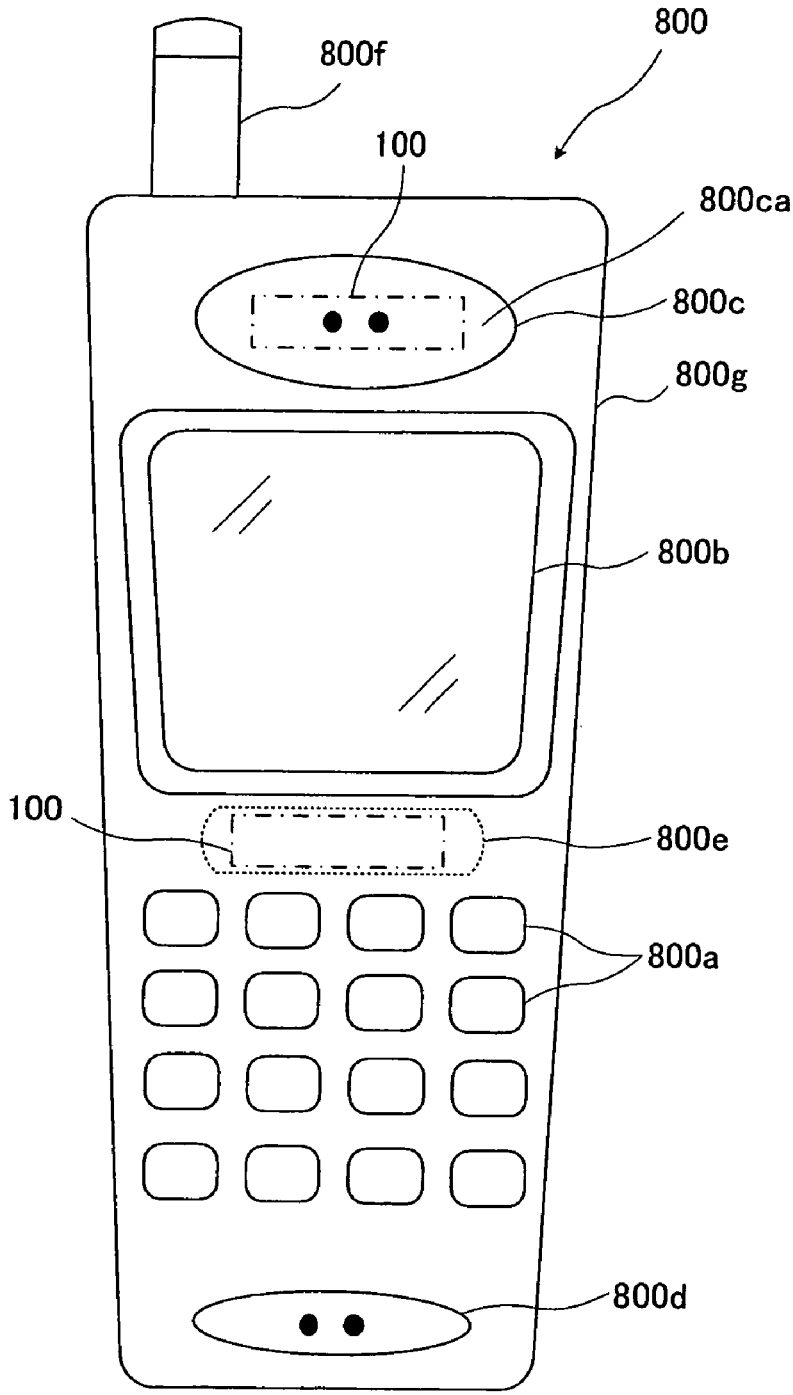
FIG. 13 is a plane view of a mobile phone using the speaker device of the present invention.

FIG. 13 is a schematic plane view showing a configuration of the mobile phone. A mobile phone 800 shown in the drawing includes plural control bottoms 800*a*, a display part 800*b*, an ear piece 800*c*, a mouth piece 800*d*, all of which are provided on a front side of a case 800*g*, a call-indicating part 800*e* provided on a back side of the case 800*g* and having a function to make a call-receiving alarm sound, and a transmitting and receiving antenna 800*f* provided on one side surface of the case 800*g*. A receiver part 800*ca* is provided in the case 800*g* corresponding to the position of the ear piece 800*c*. In the mobile phone 800 having the above configuration, the speaker device 100 which is capable of obtaining the high sensitivity and the low frequency sound output and is able to become thin and slim is loaded on the case 800*g* to be provided at positions corresponding to the receiver part 800*ca* and the call-indicating part 800*e*, for example.

The invention may be embodied on other specific forms without departing from the spirit or essential characteristics thereof. The present embodiments therefore to be considered in all respects as illustrative and not restrictive, the scope of the invention being indicated by the appended claims rather than by the foregoing description and all changes which come within the meaning an range of equivalency of the claims are therefore intended to embraced therein.

The entire disclosure of Japanese Patent Application No. 2005-368527 filed on Dec. 21, 2005 including the specification, claims, drawings and summary is incorporated herein by reference in its entirety.

What is claimed is:

1. A speaker device comprising:

a magnetic circuit which includes a magnetic gap;

a diaphragm which has a recessed part of a substantially rectangular parallelepiped shape opening toward a sound output side of the diaphragm, at least a part recessed part being arranged in the magnetic gap, and the recessed part extending in a direction substantially orthogonal with respect to a direction of a magnetic flux in the magnetic gap; and a voice coil of an annular shape, which includes: a first parallel part, at least a part of the first parallel part being arranged in the recessed part; and at least a second parallel part arranged outside of the recessed part and extending in a direction in parallel with the first parallel part, wherein the at least a part of the first parallel part is arranged in the magnetic gap, and wherein the at least a second parallel part is arranged outside of the magnetic gap.

2. A speaker device comprising:

a magnetic circuit which includes a magnetic gap;

a diaphragm which has a recessed part of a substantially rectangular parallelepiped shape opening toward a sound output side of the diaphragm, at least a part of the recessed part being arranged in the magnetic gap, and the recessed part extending in a direction substantially orthogonal with respect to a direction of a magnetic flux in the magnetic gap; and a voice coil which is formed into an annular shape comprising: a first parallel part, at least a part of the first parallel part being arranged in the recessed part; and a second parallel part extending in a direction in parallel with the first parallel part, at least a part of the second parallel part being arranged outside of the recessed part wherein the at least a part of the first parallel part is arranged in the magnetic gap, and wherein the second parallel part is arranged outside of the magnetic gap.

3. A speaker device comprising:

a magnetic circuit which includes a magnetic gap;

a diaphragm which has a recessed part arranged in the magnetic gap and extending in a direction substantially orthogonal with respect to an extending direction of a magnetic flux in the magnetic gap; and a voice coil which has a Y-shaped cross-section and has a first part having a first parallel part extending in one direction, a second part having a second parallel part extending in a direction in parallel with the first parallel part and connected with the first part to form an annular shape, and a third part having a third parallel part extending in the direction in parallel with the first parallel part and connected with the first part to form an annular shape, the third parallel part being arranged at a position symmetrical with the second parallel part with respect to a central line passing through a center in a width direction of the first parallel part, the width direction corresponding to an extending direction of the magnetic flux, wherein the first parallel part, the second parallel part and the third parallel part are arranged in a direction in parallel with an extending direction of the recessed part, respectively, and wherein an entire or one part of the first parallel part is arranged in the recessed part to be positioned in the magnetic gap, and the second parallel part and the third parallel part are positioned on an upper surface on a sound output side of the diaphragm, respectively.

4. The speaker device according to claim 2, wherein a length of the magnetic gap in a sound output direction is larger than a length of a gap between the first parallel part and the second parallel part in the sound output direction.

5. The speaker device according to claim 3, wherein a positional relation between the first parallel part and each of the second parallel part and the third parallel part is prescribed so that the second parallel part and the third parallel part are positioned in the magnetic gap, when an excessive sound current is inputted to the voice coil and the voice coil largely moves to a direction opposite to a sound output direction of the diaphragm.

6. The speaker device according to claim 1, wherein the magnetic gap is formed at a substantially central position of the magnetic circuit, and wherein the diaphragm has a plane shape formed into an elongated circular shape or ellipse shape.

7. The speaker device according to claim 2, wherein the entire or the part of the first parallel part is sandwiched and fixed by side surfaces of the recessed part.

8. The speaker device according to claim 2, wherein a direction of a sound current flowing in the first parallel part and a direction of the sound current flowing in the second parallel part are opposite to each other.

9. The speaker device according to claim 3, wherein a direction of a sound current flowing in the first parallel part and a direction of the sound current flowing in each of the second parallel part and the third parallel part are opposite to each other.

10. The speaker device according to claim 2, wherein the magnetic circuit includes a yoke, a pair of magnets formed into a rectangular parallelepiped shape, oppositely mounted with a constant space on an upper surface of the yoke, and magnetized to have different polarity at an upper part and a lower part with respect to a vibration direction of the diaphragm, and a pair of plates formed into a rectangular parallelepiped or flat-plane shape and oppositely mounted on each of upper surfaces of the pair of magnets, and wherein the magnetic gap is formed between the pair of plates.

11. The speaker device according to claim 10, wherein an additional magnet is mounted on an upper surface of at least one of the pair of plates, and wherein the additional magnet and the magnet sandwiching the plate and opposite to the additional magnet are magnetized to have different polarity at an upper part and a lower part, with respect to a vibration direction of the diaphragm.

12. The speaker device according to claim 2, wherein the magnetic circuit includes a yoke, a magnet formed into a rectangular parallelepiped shape and mounted on an upper surface of the yoke, a magnetic body oppositely mounted on the upper surface of the yoke with a constant space to the magnet, and a plate formed into a rectangular parallelepiped or flat-plane shape and mounted on an upper surface of the magnet, wherein the magnetic gap is formed between the magnet and the magnetic body.

13. The speaker device according to claim 2, wherein the magnetic circuit includes a yoke, and a pair of magnets formed into a rectangular parallelepiped shape, oppositely mounted with a constant space on an upper surface of the yoke, and magnetized to have different polarity at an upper part and a lower part with respect to an extending direction of the magnetic flux, and wherein the magnetic gap is formed between the pair of magnets.

14. The speaker device according to claim 2, wherein the magnetic circuit includes a yoke, a magnet formed into a rectangular parallelepiped shape and mounted on an upper surface of the yoke, a magnetic body oppositely mounted on the upper surface of the yoke with a constant space to the magnet, and wherein the magnetic gap is formed between the magnet and the magnetic body.

15. The speaker device according to claim 1, wherein the entire or the part of the first parallel part is arranged in the recessed part and sandwiched and fixed by side surfaces of the recessed part.

16. The speaker device according to claim 1, further comprising a frame having a plane shape formed into a cylindrical, annular, elongated circular or ellipse shape and housing the magnetic circuit, wherein a step part formed into a step state is formed at an outer peripheral portion on an upper surface of the frame, wherein the diaphragm has a sound output part provided around the recessed part, having a semi-sphere cross-section and having a function to output an acoustic wave, and a step part provided at an outer peripheral portion of the sound output part and having a step part engaged with the step part of the frame, and wherein the step part of the diaphragm becomes engaged with the step part of the frame, and the recessed part is arranged at a substantially central position of the frame.

17. The speaker device according to claim 16, wherein the sound output part has a function of an edge, and wherein a length in a lateral direction of the sound output part occupies a major part of a length in a lateral direction of the diaphragm.

18. A mobile phone comprising a speaker device including:

a magnetic circuit which includes a magnetic gap;

a diaphragm which has a recessed part of a substantially rectangular parallelepiped shape opening toward a sound output side of the diaphragm, at least a part recessed part being arranged in the magnetic gap, and the recessed part extending in a direction substantially orthogonal with respect to an extending direction of a magnetic flux in the magnetic gap; and a voice coil of an annular shape, which includes: a first parallel part, at least a part of the first parallel part being arranged in the recessed part; and at least a second parallel part arranged outside of the recessed part and extending in a direction in parallel with the first parallel part, wherein the at least a part of the first parallel part is arranged in the magnetic gap, and wherein the at least a second parallel part is arranged outside of the magnetic gap.

* * * * *